US007770986B1

(12) United States Patent
Simaitis

(10) Patent No.: US 7,770,986 B1
(45) Date of Patent: Aug. 10, 2010

(54) OVERHEAD PULL-OUT SWING-DOWN DRAWER

(76) Inventor: Vaidotas Joseph Simaitis, 1501 S. Hillcrest St., Urbana, IL (US) 61801-5003

( * ) Notice: Subject to any disclaimer, the term of this patent is extended or adjusted under 35 U.S.C. 154(b) by 419 days.

(21) Appl. No.: 11/903,411

(22) Filed: Sep. 20, 2007

(51) Int. Cl.
*A47B 67/02* (2006.01)
*A47F 5/08* (2006.01)

(52) U.S. Cl. ..... 312/247; 312/246; 312/298; 312/319.2

(58) Field of Classification Search ..... 312/247, 312/246, 301, 298, 309, 319.1–319.4
See application file for complete search history.

(56) References Cited

U.S. PATENT DOCUMENTS 723,196 A * 3/1903 Dysterud ..... 192/105 CF
806,277 A 12/1905 McKee
1,381,361 A 6/1921 Studer
1,893,624 A * 1/1933 Webb ..... 224/281
2,257,625 A 9/1941 Thomas
2,460,681 A * 2/1949 Davis ..... 312/304
2,590,341 A 3/1952 Nabholz
2,635,030 A * 4/1953 Stebbins et al. ..... 312/319.3
2,776,866 A * 1/1957 Harbison ..... 312/311
2,822,229 A * 2/1958 Carlson ..... 312/27
2,919,966 A * 1/1960 Preston ..... 312/27
3,081,138 A * 3/1963 Stebbins ..... 312/319.3
3,224,827 A * 12/1965 Foster et al. ..... 312/266
3,586,324 A * 6/1971 Bearson ..... 473/484
3,976,316 A 8/1976 Laby
4,026,434 A * 5/1977 Howard ..... 220/478
4,076,351 A * 2/1978 Wyant ..... 312/247
4,723,680 A * 2/1988 Carroll et al. ..... 220/478
4,749,242 A 6/1988 Rechberg
5,058,846 A * 10/1991 Close ..... 248/284.1
5,224,677 A * 7/1993 Close ..... 248/292.11
5,226,714 A 7/1993 Wright
5,228,763 A * 7/1993 Gingold ..... 312/266
5,302,015 A * 4/1994 Du Vall ..... 312/282
5,308,158 A * 5/1994 Vogelgesang et al. .... 312/319.3
5,549,052 A * 8/1996 Hoffman ..... 108/139
5,646,819 A 7/1997 Hill, III
5,857,756 A * 1/1999 Fehre ..... 312/246
6,045,204 A * 4/2000 Frazier et al. ..... 312/247
6,073,624 A * 6/2000 Laurent ..... 126/334
6,309,038 B1 * 10/2001 Domenig ..... 312/246
6,336,692 B1 1/2002 Snyder
6,523,919 B1 2/2003 Israelsen et al.
6,572,168 B1 6/2003 Radstake
6,574,835 B2 * 6/2003 Melhuish ..... 16/282
6,622,345 B2 9/2003 Liu et al.

(Continued)

*Primary Examiner*—Janet M Wilkens
*Assistant Examiner*—Dan Rohrhoff
(74) *Attorney, Agent, or Firm*—Singleton Law Firm, P.C.; Alan R. Singleton

(57) ABSTRACT

A pivot assembly that can be inserted into kitchen cabinets to utilize otherwise unused and unreachable overhead spaces over kitchen wall cabinets. The pivot assembly has a pair of pivot arms pivotally connected to opposite sides of a frame, the frame slidably attached within a cabinet. A drawer is connected to the pivot assembly between the pivot arms. The drawer slides out of the cabinet on a pair of drawer slides and rotates down and out 180 degrees on the pivot arms, from an up position to a down position, wherein the drawer remains stable even as the pivot arms pass through a middle position. The pivot arms form a primary and secondary parallelogram shape during operation, the secondary parallelogram supporting the primary parallelogram at its weakest point in the middle position.

29 Claims, 17 Drawing Sheets

U.S. PATENT DOCUMENTS 6,691,878 B1 * 2/2004 Ouitz ..... 211/104
6,991,199 B2 * 1/2006 Carpentier ..... 248/122.1
7,258,406 B2 * 8/2007 Stephan et al. ..... 312/246
7,448,703 B2 * 11/2008 Kung ..... 312/327
7,488,048 B2 * 2/2009 Paganini ..... 312/249.11
2005/0206282 A1 * 9/2005 Walburn ..... 312/312
2007/0236114 A1 * 10/2007 Fuentes ..... 312/246
2008/0129168 A1 * 6/2008 Banta et al. ..... 312/333

* cited by examiner

OVERHEAD PULL-OUT SWING-DOWN DRAWER

BACKGROUND OF THE INVENTION

The present invention provides a way to utilize otherwise unreachable overhead spaces, especially in kitchen cabinetry, where the wall cabinets often end at about 7 feet, and the ceiling is at 8 feet or more. These spaces are often occupied by soffits, or are left open.

By installing new open-faced cabinets in these spaces, the mechanism embodied in this invention can be inserted with an appropriate drawer and front door or drawer front. The cabinets and door or front can match the already existing cabinetry.

The invention can also be used without a front door, where there are very tall cabinets already in place, and where the top shelf is too high to reach easily. In this situation, the top shelf can be replaced by the swing-down open front drawer, which is normally hidden by the existing cabinet doors.

The solution to this task is identified by the features declared in the claims.

Additionally, the invention can be utilized beyond the realm of kitchen cabinets by providing a way to easily lower objects with a new and useful pivot assembly.

SUMMARY OF THE INVENTION

The invention embodies the solution to wasted high spaces. First a frame is constructed. The frame is like an upside down drawer with an open front and open bottom. The frame is mounted inside the cabinet on drawer slides which provide over-travel, so the frame and its contents can be pulled out entirely clear of the cabinet. The sides of the frame are assemblies which contain the critical parts of the invention. The assemblies allow an actual drawer with an open top and front to be mounted to the frame, and the assemblies also allow the drawer to swing forward and down 180°, to a level which is more easily reached by the average person. A front door hinged at the bottom of the drawer can then be opened down for access to the drawer's contents.

Producing this motion and maintaining the drawer in a horizontal orientation involves the use of a pivot system which forms parallelograms, formed by the frame, the drawer attachments or bars, and pivot arms, on each side of the drawer. There are two problems with parallelograms when the 4 pivot axes are all in one plane.

The most severe problem occurs at that point where the parallelogram becomes undefined (i.e., the angles inside the parallelogram are at zero degrees so that it is in fact a line as opposed to a parallelogram). The pivot assembly entering this state may suddenly emerge at some awkward angle. This embodiment solves this situation by implementing a secondary, outer parallelogram in the pivot assembly which overrides this instability.

The second problem is that if a fixed base pivot distance is shorter or even near the swing arm pivot distance, a first pivot arm would run into a second pivot arm, making rotation through 0° impossible. The subject invention also solves this problem by beveling the pair of pivot arms so that they bypass each other.

Without some assistance, the rotation from 90° up to 90° down would be a very difficult motion to control, because of the weight of the drawer, its contents, and the door. It would be extremely difficult to push the drawer back up. An embodiment of this invention solves this difficulty with the use of extension springs to help pull the drawer closed. The choice of extension springs and the location of the spring attachment points in respect to the pivot points of the parallelogram can be important to the successful operation of the embodiment and involve extensive calculations of torques. The primary function of the extension springs is to counter the torque produced by the weight of the swinging drawer. By properly placing the spring points, a secondary effect is to hold the drawer open when it is in the down position, and help it close when in the up position.

DETAILED DESCRIPTION OF THE INVENTION

Figure 1:
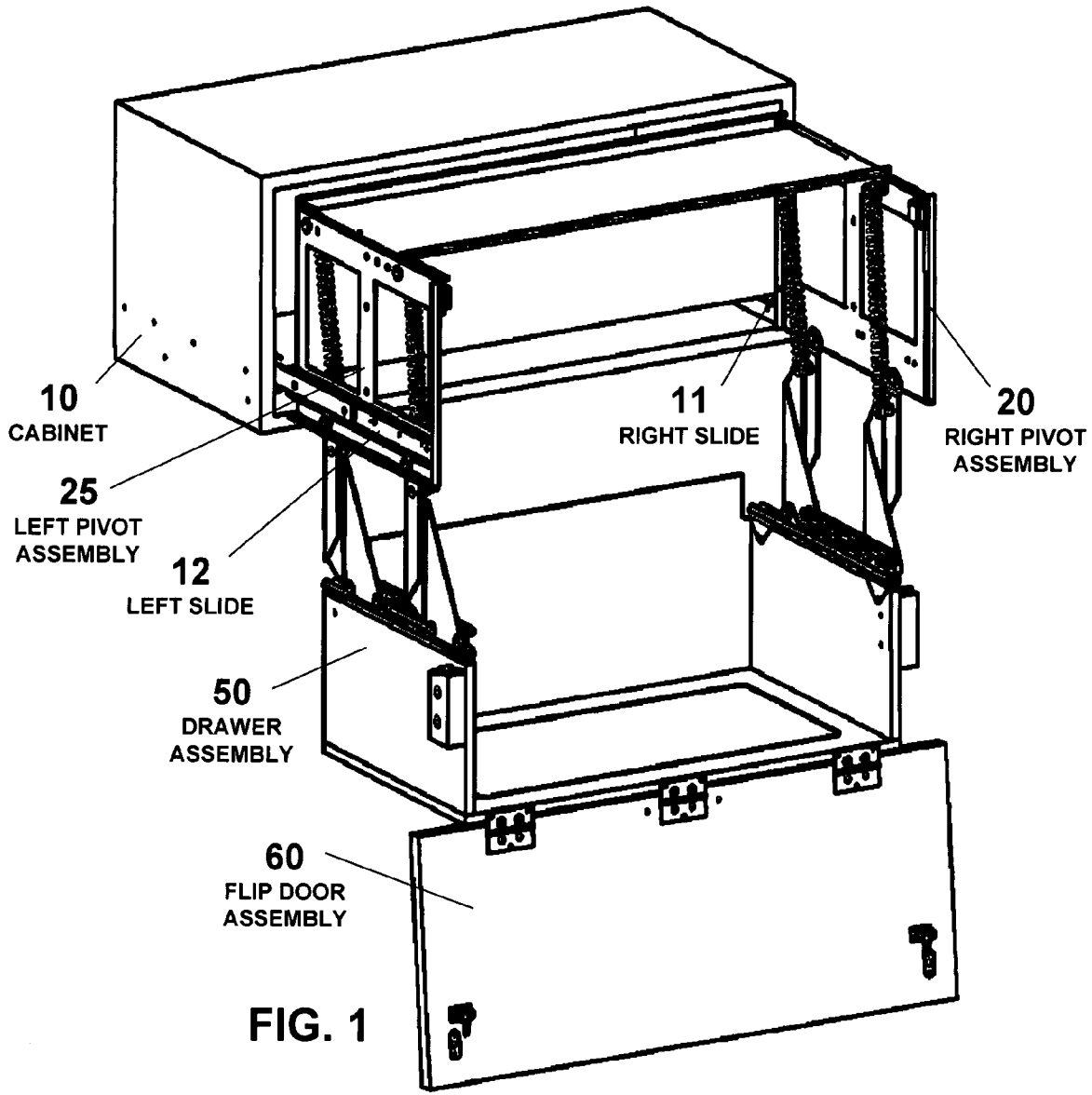
FIG. 1 is a perspective view of the embodiment of the invention showing the drawer swung down and the door open for access.

As shown in FIG. 1, a conventional kitchen cabinet 10 usually composed of wood can be mounted above existing wall cabinets. Commercial drawer slides, right slide 11 and left slide 12, are attached to both inside sides of the cabinet 10. The slides are preferably ones with provisions for over-travel when extended. A slide catch (81, as shown in FIG. 2) may be used on the end of each slide (right slide 11 and left slide 12) to stop the drawer assembly 50 from traveling beyond a desired length as the drawer assembly 50 slides out of the cabinet 10. Right pivot assembly 20 attaches to the inside of right slide 11. The left pivot assembly 25 attaches to the inside of left slide 12. The drawer assembly 50 is then attached to the pivot assemblies 20 and 25, and flip door assembly 60 in turn is attached to drawer assembly 50. FIG. 1 shows the drawer in the swing-down position with the door flipped open.

Figure 2A:
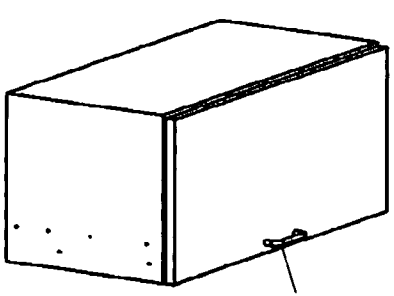
FIG. 2*a* through FIG. 2*e* illustrate the sequence of movement of the parts from the closed to the fully open position.
Figure 2B:
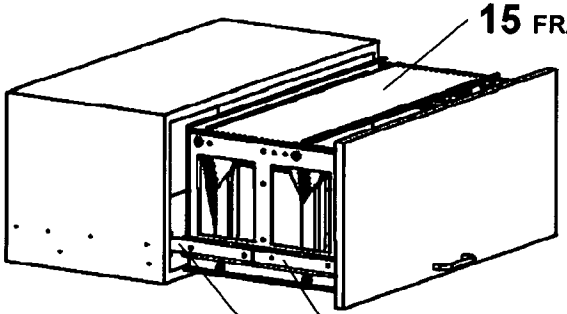
Figure 2C:
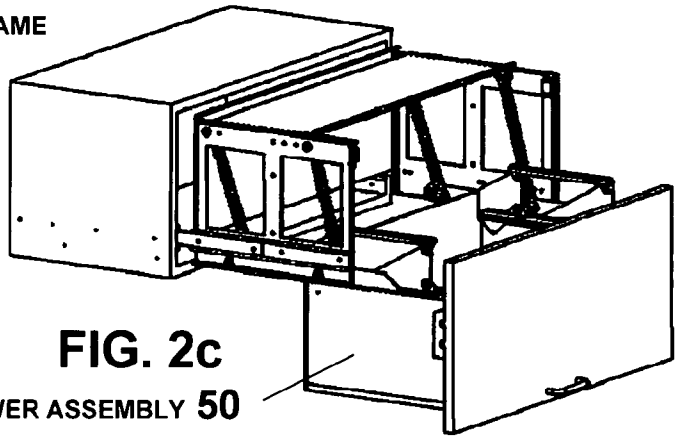
Figure 2D:
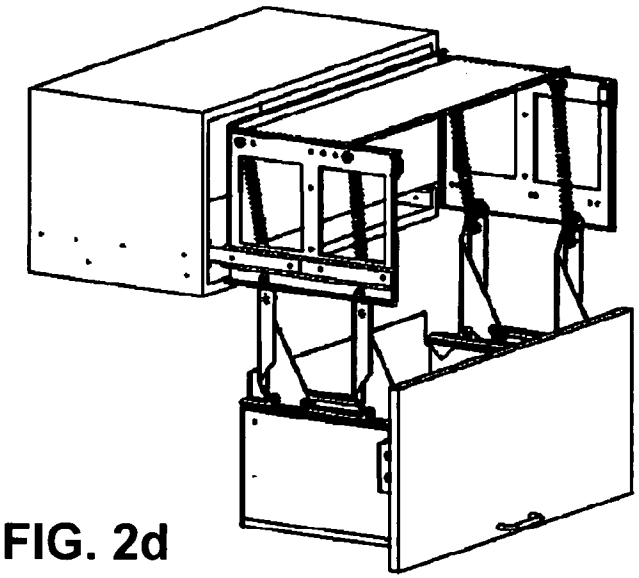
Figure 2E:
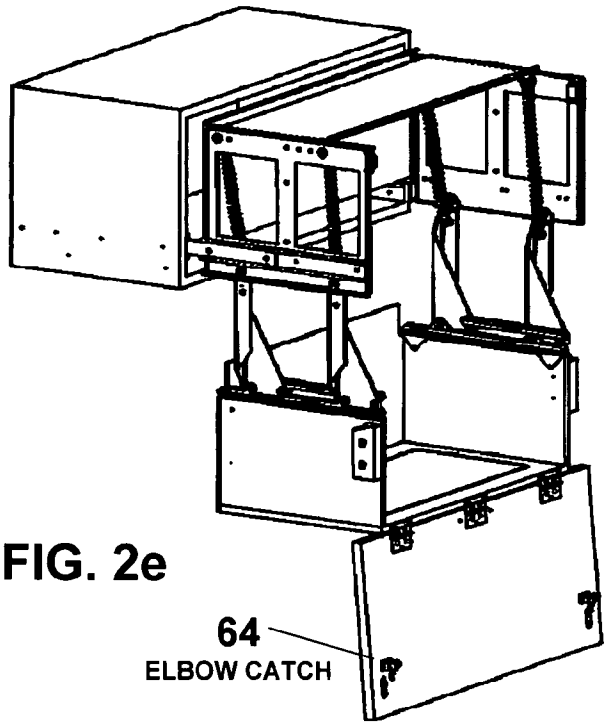
Figure 3:
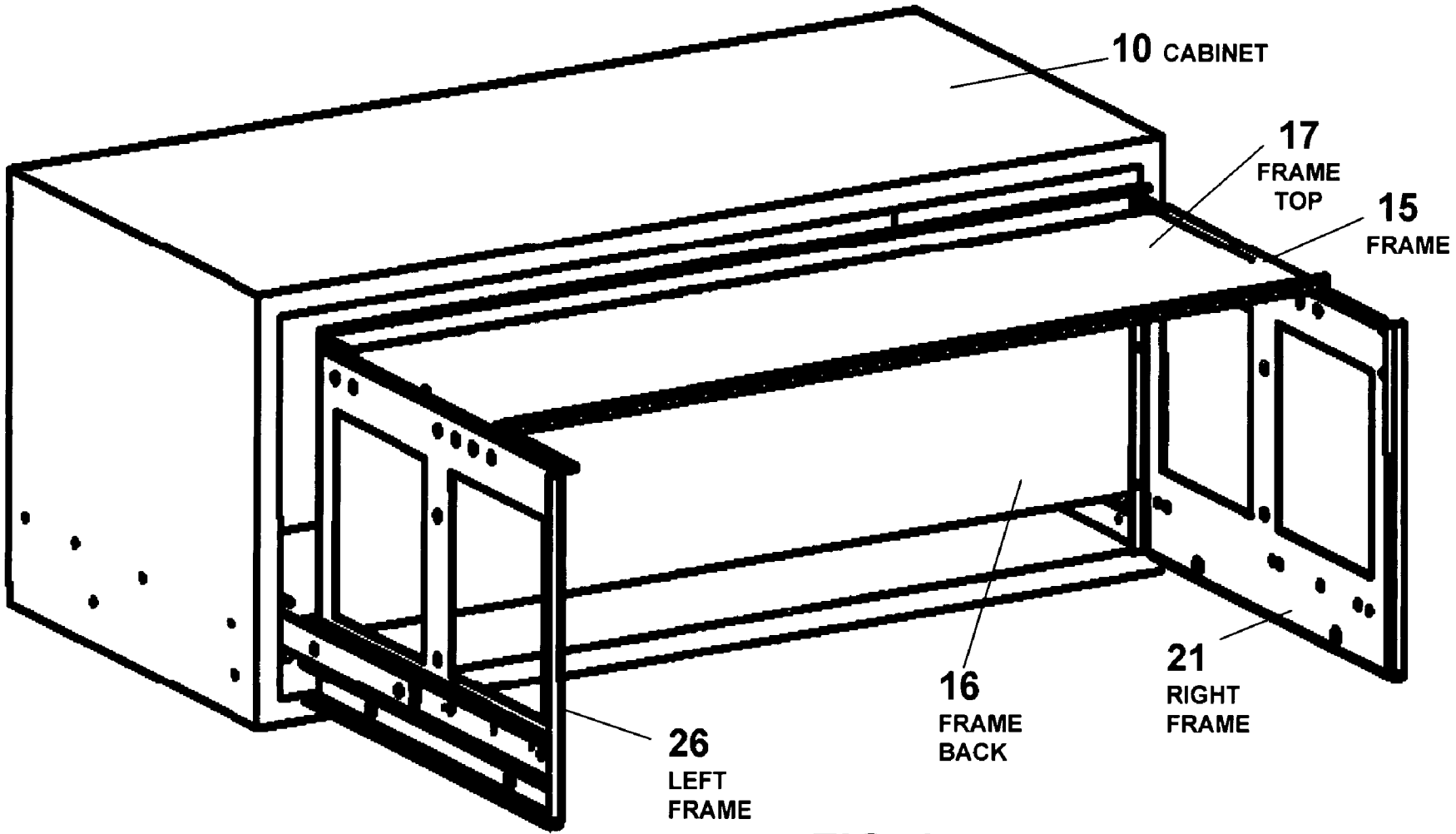
FIG. 3 is a perspective view of the parts of the invention which form the rigid upside-down drawer frame.
Figure 4:
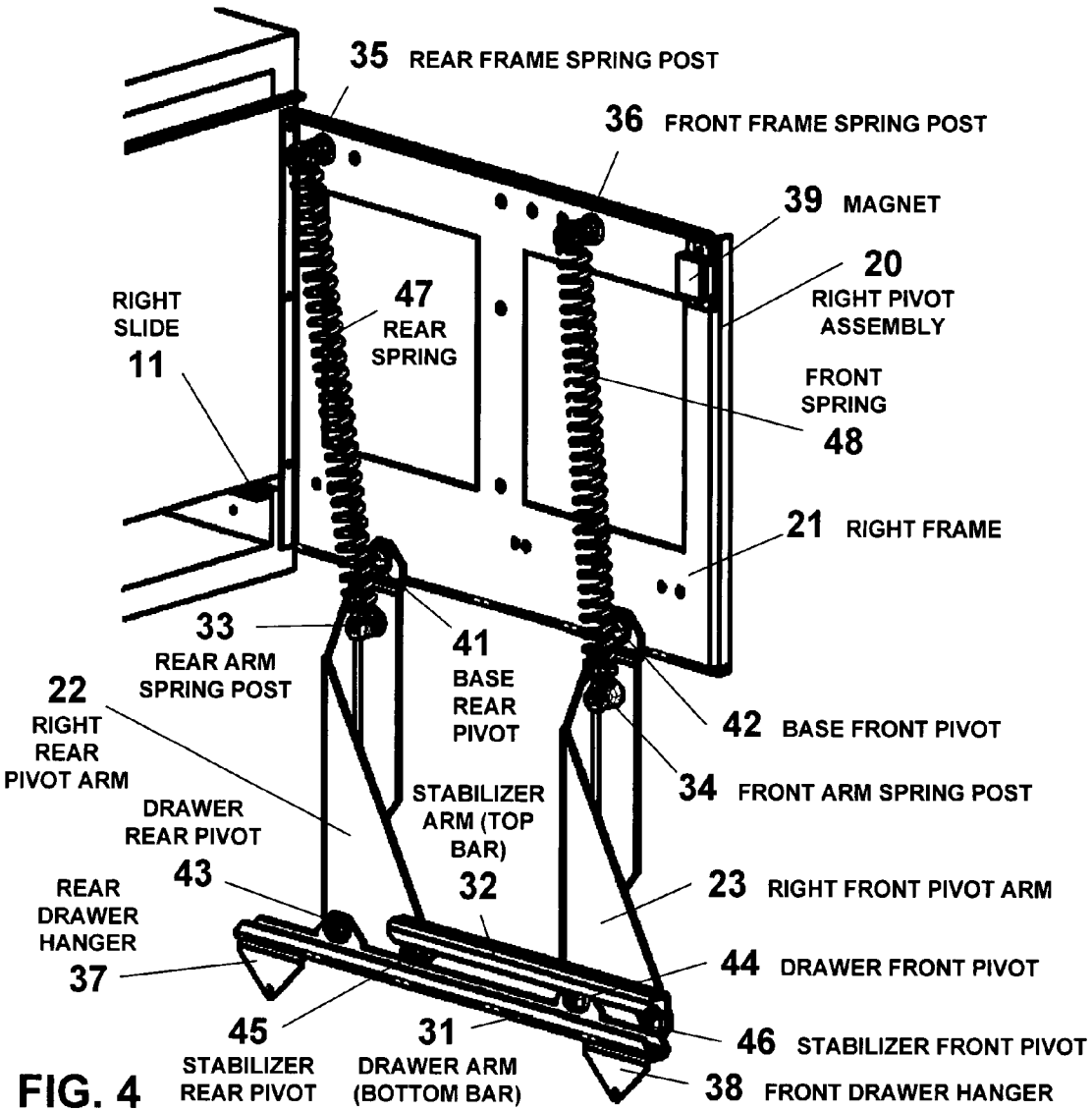
FIG. 4 is a perspective view of the details of the right pivot assembly.

FIG. 2*a* through FIG. 2*e* clockwise from upper left illustrates the sequence of movement of the parts from the closed to the fully open position. By grasping a door handle 62 on the drawer assembly 50, a rigid frame 15 is pulled out horizontally until the frame 15 and the slides (left slide 12 shown; right slide 11, as shown in FIG. 1) stop at their full extension due to a slide catch 81. A hooking tool (80, as shown in FIG. 14) may be used to pull on the door handle 62 or otherwise hook to the drawer and pull it out of the cabinet (10, as shown in FIG. 1 and FIG. 3). The momentum of the drawer assembly 50 moving outward breaks the magnetic latches when the slides (left slide 12 shown; right slide 11, as shown in FIG. 1) are at a full extension, and the pivot assembly starts a pivoting motion outward and downward. Continuing the pivoting motion takes the drawer all the way downward until the over-center extension springs (rear spring 47 and front spring 48, as shown in FIG. 4) snap the drawer fully open. Releasing the elbow catch 64 then allows the flip door to be lowered.

Figure 5:
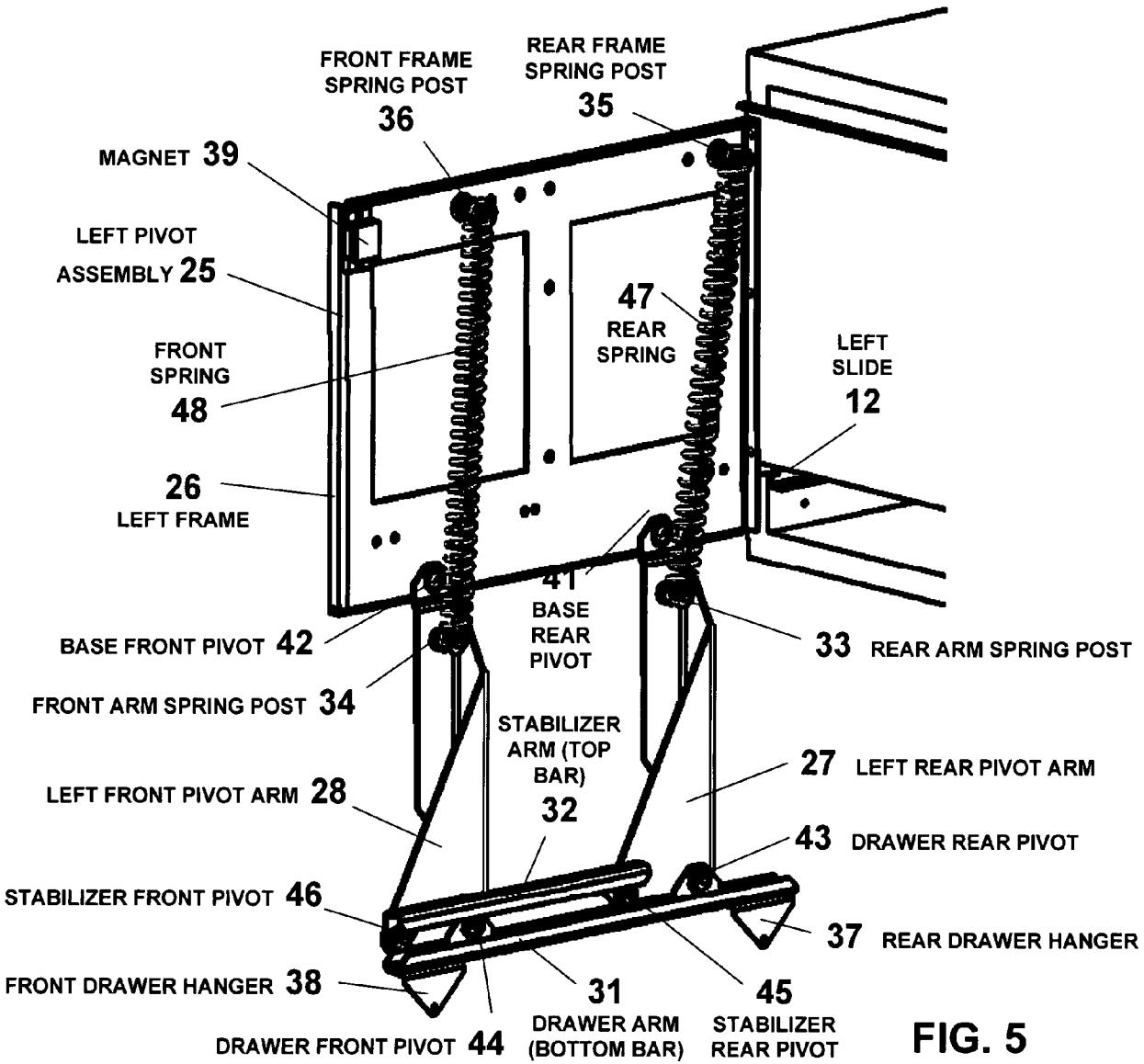
FIG. 5 is a perspective view of the details of the left pivot assembly.

FIG. 3 shows the rigid frame 15 which is assembled to fit inside the cabinet 10. It creates an upside down drawer, but with the front open. The frame is formed by the right frame 21 of the right pivot assembly (20, as shown in FIG. 4), left frame 26 of the left pivot assembly (25, as shown in FIG. 5), frame back 16 and frame top 17. The left frame 26 may be described as a rigid element for mounting the left pivot arms (left rear pivot arm 27 and left front pivot arm 28, as shown in FIG. 5), and the right frame 21 may be described as a rigid element used for mounting the right pivot arms (right rear pivot arm 22 and right front pivot arm 23, as shown in FIG. 4). Frame back 16 and frame top 17 contain bends along their length, or longitudinal bends, to give them stiffness, which minimizes twisting of the assembly under the loading of the extension springs and drawer contents.

FIG. 4 is a perspective view of the details of the right pivot assembly 20. The base of this assembly is right frame 21 which on its outside attaches to the extendable side of right slide 11. Right rear pivot arm 22 and right front pivot arm 23 are pivotally attached along the bottom of right frame 21 with, respectively, base rear pivot 41 and base front pivot 42. Drawer arm (bottom bar) 31 is pivotally attached to right rear pivot arm 22 with drawer rear pivot 43 and to right front pivot arm 23 with drawer front pivot 44. Stabilizer arm (top bar) 32 is pivotally attached to right rear pivot arm 22 with stabilizer rear pivot 45 and to right front pivot arm 23 with stabilizer front pivot 46.

Drawer arm 31 could also be described as the bottom bar, and the stabilizer arm 32 could be described as the top bar. The alternate names come from a geometric viewpoint because the top bar is above the bottom bar.

FIG. 4 also shows how the extension springs (rear spring 47 and front spring 48) connect to the right pivot arms (right rear pivot arm 22 and right front pivot arm 23, respectively). Rear spring 47 is attached to right rear pivot arm 22 with rear arm spring post 33 and to right frame 21 with rear frame spring post 35. Front spring 48 is attached to right front pivot arm 23 with front arm spring post 34 and to right frame 21 with front frame spring post 36. Rear drawer hanger 37 and front drawer hanger 38 are attached to drawer arm (bottom bar) 31. A standard cabinet magnet 39 is attached at the upper front corner of right frame 21.

FIG. 5 is a perspective view of the details of the left pivot assembly 25. The base of this assembly is left frame 26 which on its outside attaches to the extendable side of left slide 12. Left rear pivot arm 27 and left front pivot arm 28 attach along the bottom of left frame 26 with, respectively, base rear pivot 41 and base front pivot 42. Drawer arm (bottom bar) 31 is attached to left rear pivot arm 27 with drawer rear pivot 43 and to left front pivot arm 28 with drawer front pivot 44. Stabilizer arm (top bar) 32 is attached to left rear pivot arm 27 with stabilizer rear pivot 45 and to left front pivot arm 28 with stabilizer front pivot 46.

FIG. 5 also shows how the extension springs (rear spring 47 and front spring 48) connect to the left pivot arms (left rear pivot arm 27 and left front pivot arm 28, respectively). Rear spring 47 is attached to left rear pivot arm 27 with rear arm spring post 33 and to left frame 26 with rear frame spring post 35. Front spring 48 is attached to left front pivot arm 28 with front arm spring post 34 and to left frame 26 with front frame spring post 36. Rear drawer hanger 37 and front drawer hanger 38 are attached to drawer arm (bottom bar) 31. A standard cabinet magnet 39 is attached at the upper front corner of left frame 26.

Left pivot assembly 25 is essentially a mirror image of the right pivot assembly 20. Referring to FIG. 4 and FIG. 5, left frame 26 is a mirror of right frame 21, left rear pivot arm 27 is a mirror of right rear pivot arm 22, and left front pivot arm 28 is a mirror of right front pivot arm 23. All other parts of the left pivot assembly are identical to the corresponding parts of right pivot assembly 20. Further descriptions of the right pivot assembly 20 will also be applicable to the left pivot assembly 25.

Figure 6:
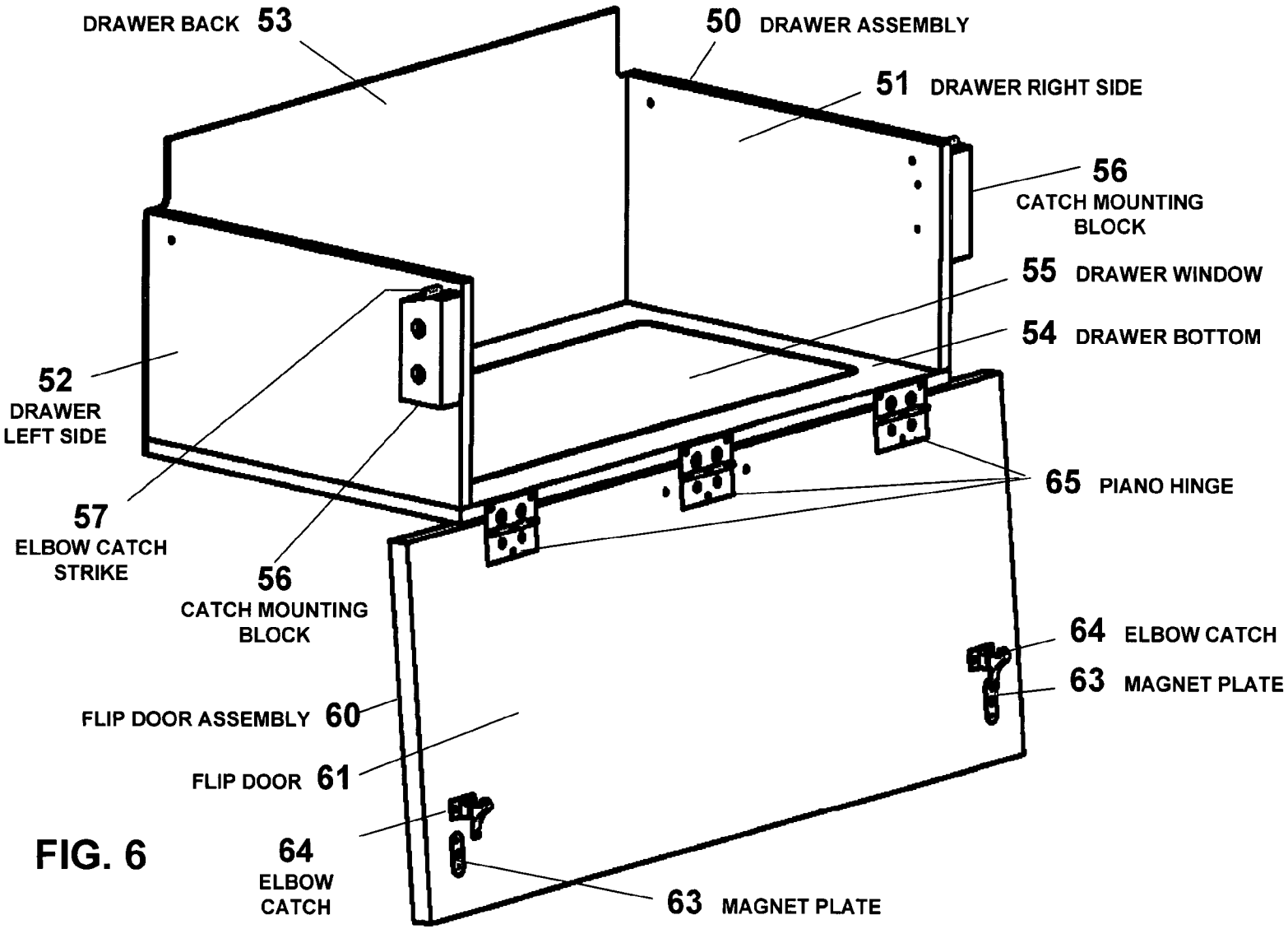
FIG. 6 is a side view of the drawer and the flip-down door assembly.
Figure 15:
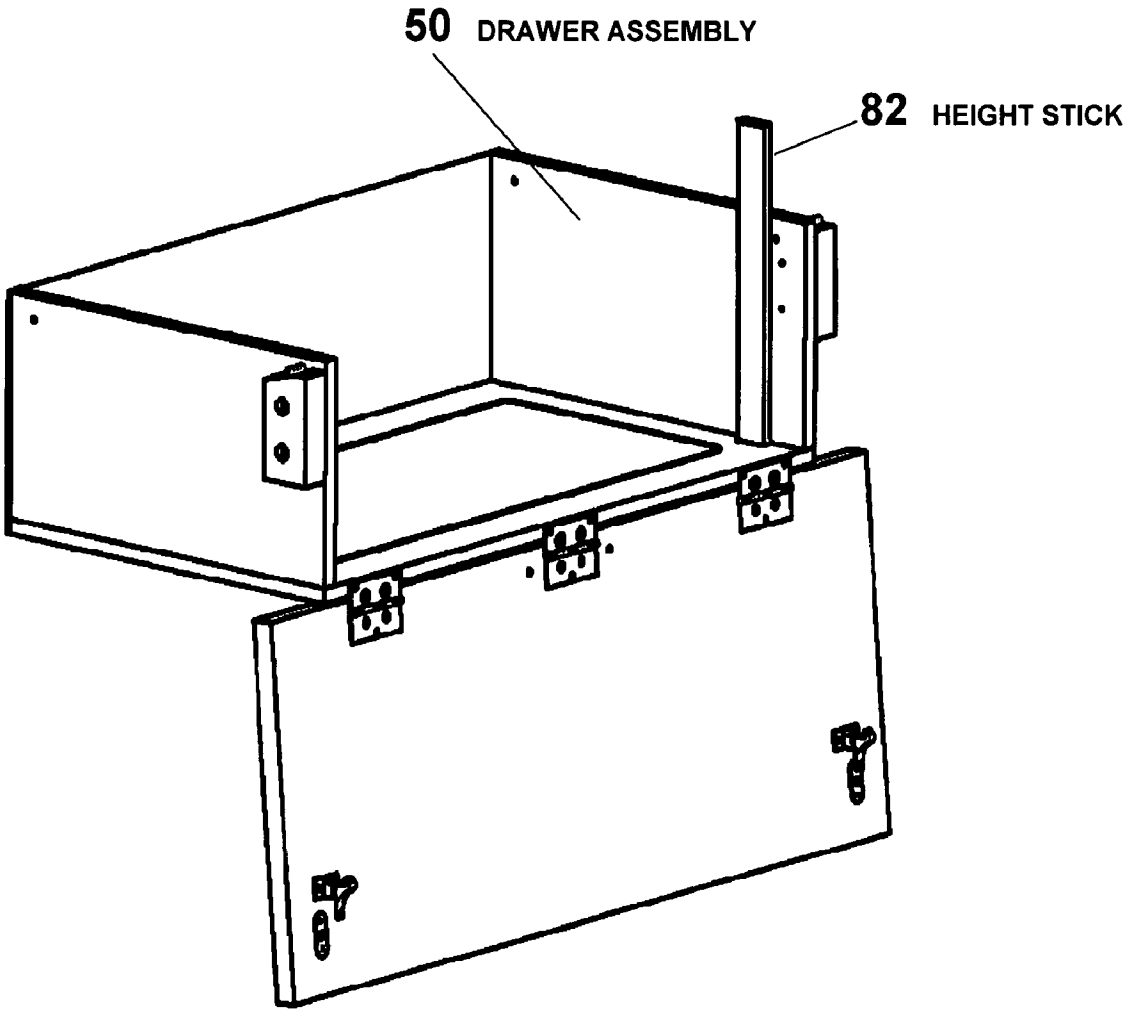
FIG. 15 shows the drawer assembly utilizing a height stick.

FIG. 6 is a perspective view of the drawer and the flip-down door assembly. Drawer assembly 50 can be assembled in numerous ways, and from various materials, as may suit the final user. The implementation shown is of plywood drawer right side 51, drawer left side 52, drawer back 53, drawer bottom 54 with an opening for a bottom window, and a drawer window 55. The drawer back 53 can be made thinner and taller than the side panels, the tallest that will fit inside the rigid frame (15, as shown in FIG. 3) to indicate the maximum height of items which can be placed in the drawer. In an alternate embodiment, a height stick (82, as shown in FIG. 15) is mounted vertically in the drawer. Drawer right side 51 and drawer left side 52 have appropriate holes for mounting to rear drawer hangers (37, as shown in FIG. 4 and FIG. 5) and front drawer hangers (38, as shown in FIG. 4 and FIG. 5).

In another embodiment, the entire drawer bottom 54 may be made from transparent material. The purpose of a transparent bottom of the drawer is so that the contents can be easily seen from underneath by just extending right slide (11, as shown in FIG. 1) and left slide (12, as shown in FIG. 1), without having to swing the drawer down and flip the door open.

Where a flip-down door is implemented, the drawer assembly 50 can utilize a catch mounting block 56 which is used to mount the elbow catch strike 57, the fixed part of a standard elbow catch. Only one is required, and can be mounted on either side as desired by the user. Also two or three modified piano hinges 65 are attached to the drawer bottom 54 of the drawer and to the flip door 61, to allow the door to swing open. The flip door assembly 60 is then attached to these hinges.

The flip door 61 can be any material to match existing cabinetry. Two magnet plates 63 are attached to the back of the door to align with magnets (39, as shown in FIG. 4 and FIG. 5) when the door is closed. The magnet plates and magnets may be referred to, collectively, as a magnetic latch. One elbow catch 64 is also attached to the back of the door to align with the elbow catch strike 57. A door handle (62, as shown in FIG. 2*a*) may be included at the bottom front of the door.

Figure 7:
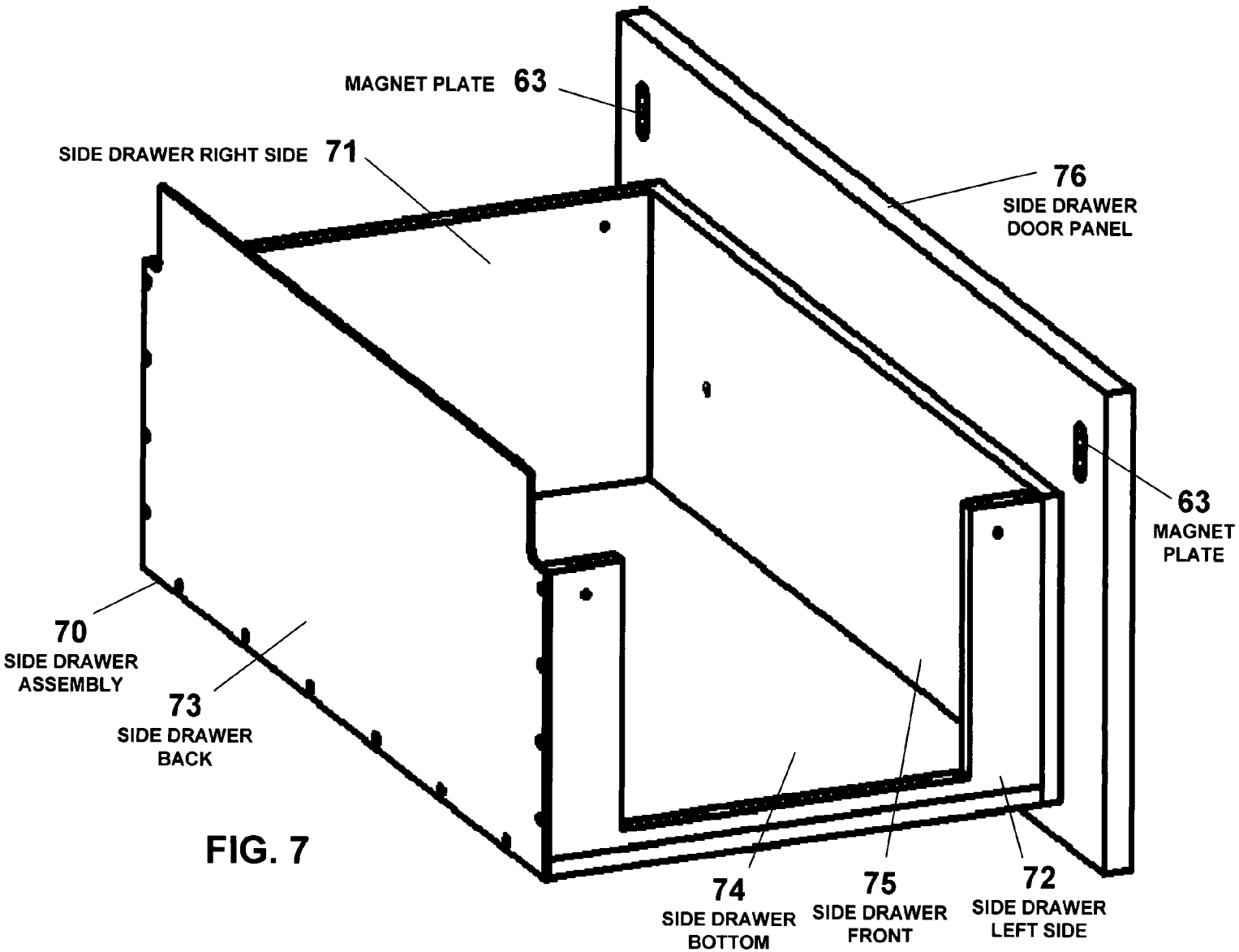
FIG. 7 is a perspective view of an alternate drawer for side access with a fixed door.
Figure 8:
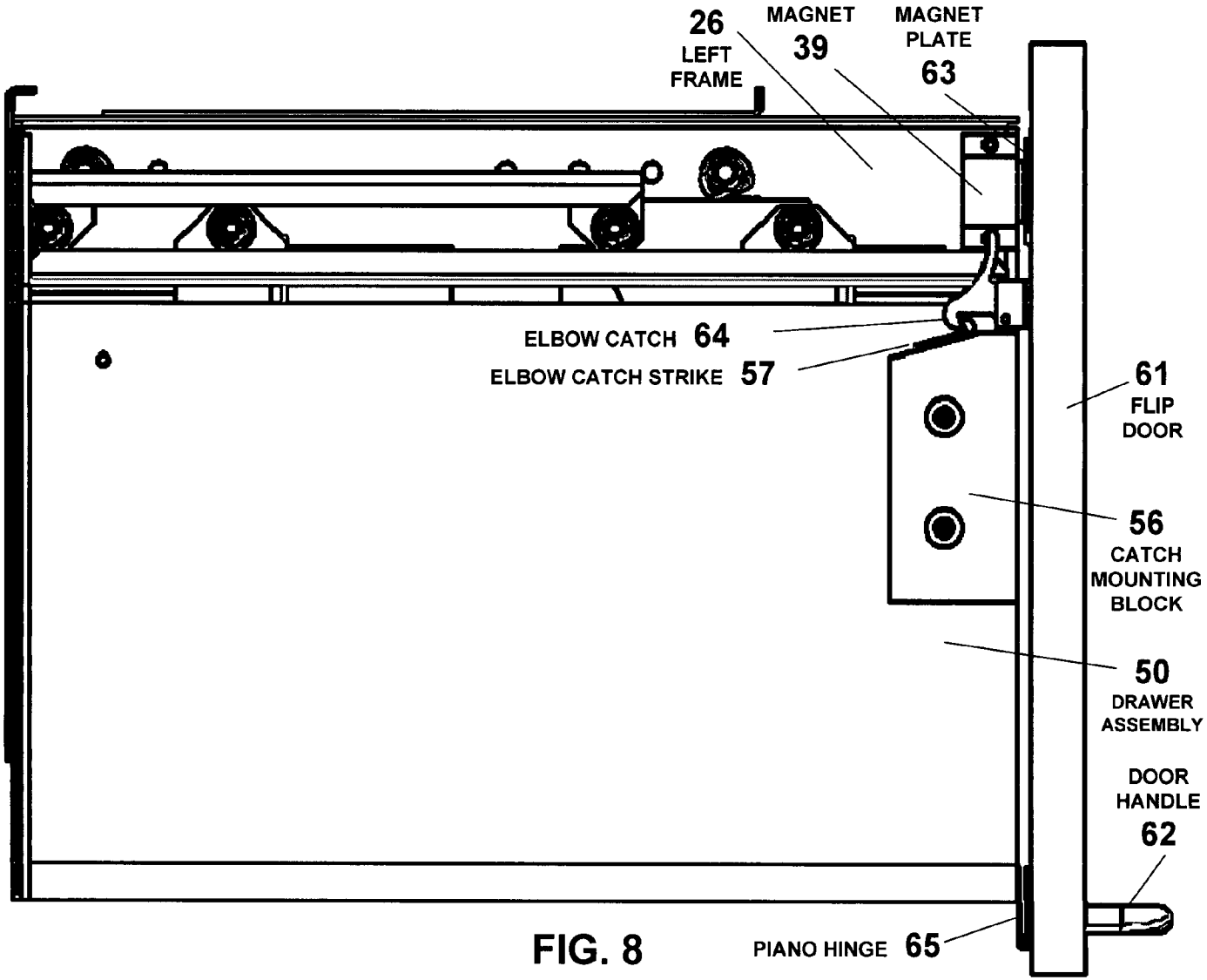
FIG. 8 is a side view showing the details of the elbow catch, the magnet latch, and the hinges, for a flip down door.

FIG. 7 is a perspective view of an alternate drawer for side access with a fixed door. Where a flip door (61, as shown in FIG. 6 and FIG. 8) is not desired, a different drawer assembly, with a fixed drawer front and a cutout for access in either the left or right drawer side, can be implemented. In this case parts shown in FIG. 6—the catch mounting block 56, elbow catch strike 57, elbow catch 64, and piano hinges 65 are omitted. Side drawer door panel 76 is then directly mounted to the side drawer front 75. The two magnet plates 63 are included. This arrangement is especially useful when the drawer is deeper than it is wide.

FIG. 7 illustrates this arrangement for access from the left side. Side drawer assembly 70 can be assembled in numerous ways, and from various materials, as may suit the final user. The implementation shown is of plywood side drawer right side 71, side drawer left side 72, side drawer back 73, side drawer bottom 74, side drawer front 75. The side drawer back 73 can be made taller than the sides, the tallest that will fit inside the rigid frame (15, as shown in FIG. 3), to indicate the maximum height of items which can be placed in the drawer. The side drawer right side 71 and the side drawer left side 72 have appropriate holes for mounting to rear drawer hanger (37, as shown in FIG. 4 and FIG. 5) and front drawer hanger (38, as shown in FIG. 4 and FIG. 5). A side drawer door panel 76 is attached to side drawer front 75. The two magnet plates 63 are included on the side drawer door panel 76, as well as a door handle which is hidden in this view.

A see-through drawer bottom (54, as shown in FIG. 6) is not as useful in this implementation since the contents of the drawer are easily seen by simply extending the right slide (11, as shown in FIG. 1) and left slide (12, as shown in FIG. 1). However, a see-through drawer bottom is still possible if desired, accomplished by making drawer bottom (54, as shown in FIG. 6) with a transparent material or setting a drawer window (55, as shown in FIG. 6) in drawer bottom (54, as shown in FIG. 6).

FIG. 8 is a left side view of the drawer assembly 50 showing the details of the elbow catch, the magnet latch, and the hinges, for a flip down door. The magnet 39 is attached to the left frame 26. Similarly on the other side another magnet is attached to the right frame. Said magnets 39 align with corresponding magnet plates 63 attached to the flip door 61. The magnets 39 are utilized, when initially extracting the rigid frame (15 as shown in FIG. 3) on the slides (right slide 11 and left slide 12, as shown in FIG. 1) with a door handle 62, to keep the drawer assembly 50 from starting to pivot out and down prematurely and thus jamming the drawer assembly 50 against the bottom of the cabinet (10 as shown in FIG. 1 and FIG. 3).

Elbow catch 64 is attached to flip door 61 on one side. It engages the elbow catch strike 57 mounted to drawer assembly 50 by catch mounting block 56. This keeps the flip door 61 firmly attached to the drawer assembly 50 during the horizontal extraction and pivoting motions. Elbow catch 64 may then be disengaged when the drawer assembly 50 is in the down position, at which time the flip door 61 can be flipped down on the piano hinges 65.

Figure 9A:
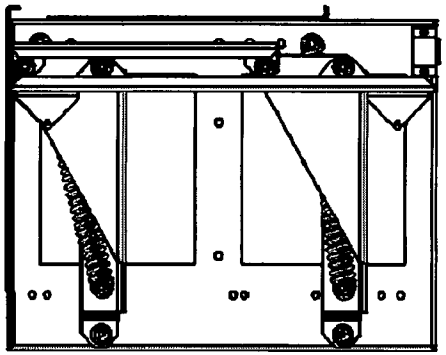
FIG. 9*a* through FIG. 9*e* illustrate the sequence of movement of the right pivot assembly parts from the closed to the fully open position.
Figure 9B:
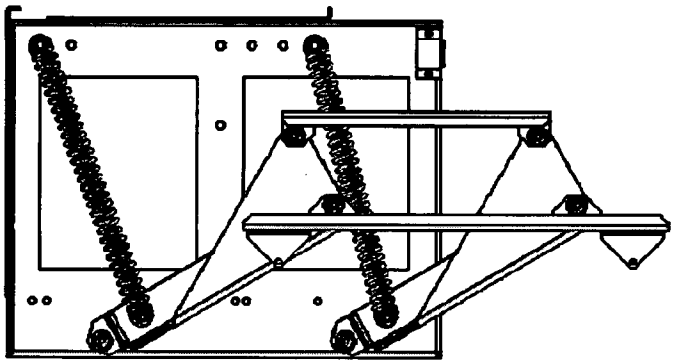
Figure 9C:
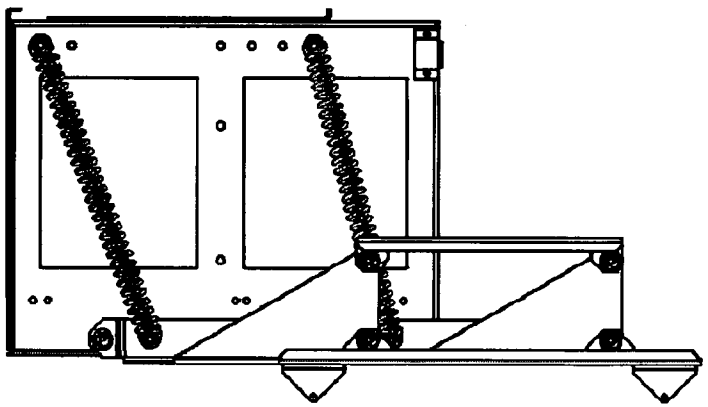
Figure 9D:
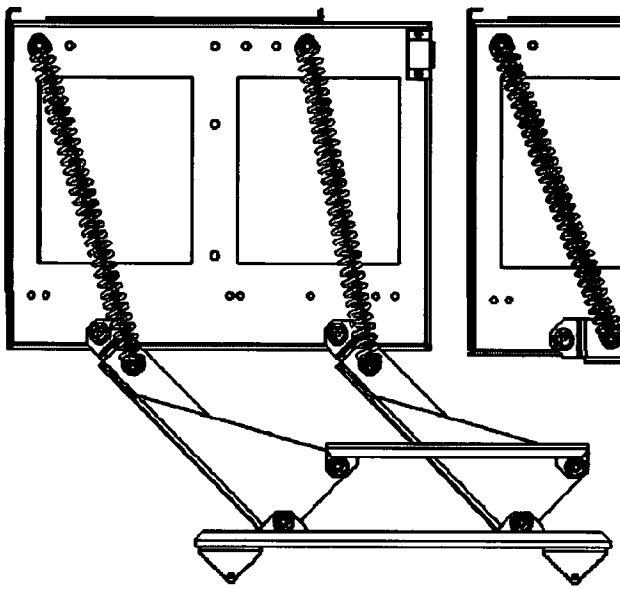
Figure 9E:
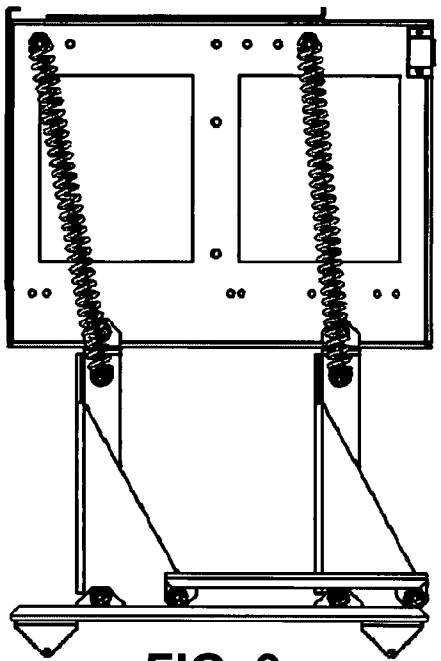
Figure 10:
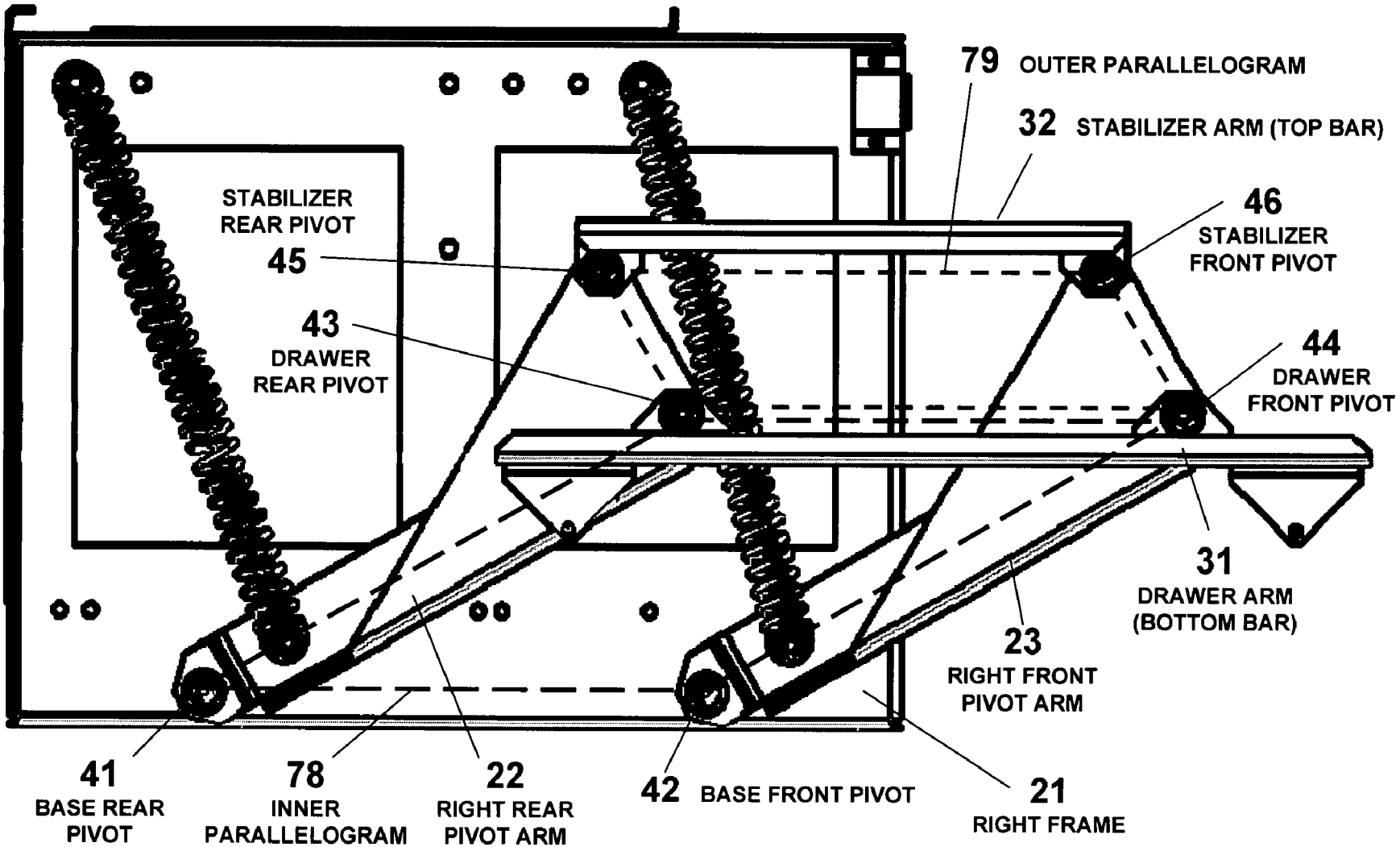
FIG. 10 is a side view of the right pivot assembly, showing the primary and the secondary parallelograms.

FIG. 9*a* through FIG. 9*e* illustrates, clockwise from the upper left, the sequence of movement of the right pivot assembly (20, as shown in FIG. 4) from the closed position (FIG. 9*a*) to the fully open position (FIG. 9*e*). The pivot assembly rotates a full 180° about each base pivot. This rotation is made possible by the implementation of a parallelogram shape formed by the pivot assembly, also called the inner parallelogram (78, as shown in FIG. 10), which requires the opposite pivot arms to be parallel to each other. However rotation through an angle where all four sides of the inner parallelogram (78, as shown in FIG. 10), including the front pivot arm, the rear pivot arm, and the lines connecting the ends of the front pivot arm to the rear pivot arm, become aligned puts the inner parallelogram (78, as shown in FIG. 10) into an unpredictable state, which will be illustrated in FIG. 11*b*.

FIG. 10 shows how the unpredictable state can be overcome by the use of a second parallelogram, also called the outer parallelogram 79, which supplements the first parallelogram, or inner parallelogram 78. The pivot assembly with an outer parallelogram 79 is implemented as shown in FIG. 10 of the right pivot assembly. The inner parallelogram 78 is formed by right frame 21, right rear pivot arm 22, right front pivot arm 23, and drawer arm (bottom bar) 31, and the pivot points: base rear pivot 41, base front pivot 42, drawer rear pivot 43, and drawer front pivot 44. The stabilizing outer parallelogram 79 is formed by drawer arm (bottom bar) 31, right rear pivot arm 22, stabilizer arm (top bar) 32, and right front pivot arm 23, and the pivot points: drawer rear pivot 43, drawer front pivot 44, stabilizer rear pivot 45, and stabilizer front pivot 46.

Figure 17A:
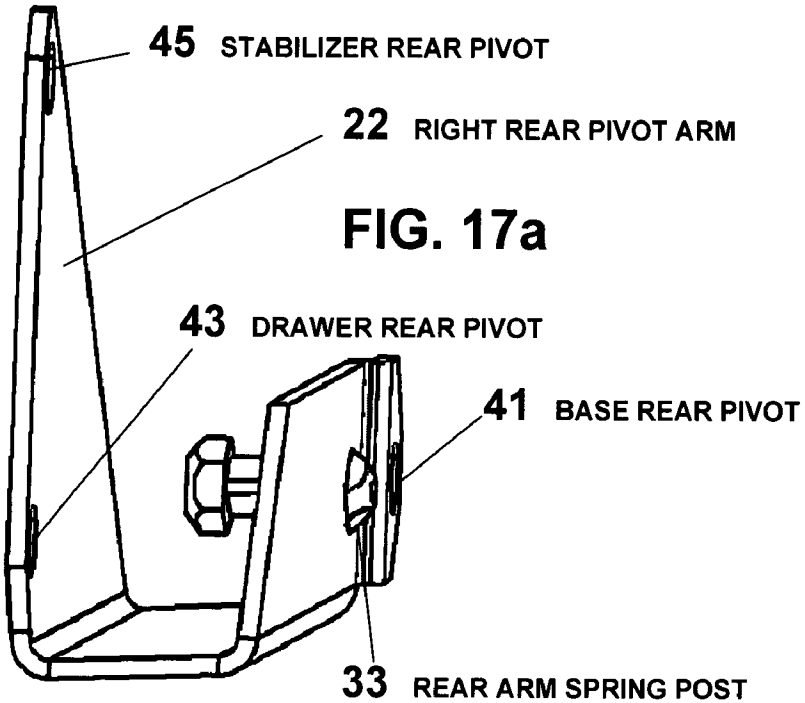
FIG. 17*a* and FIG. 17*b* are perspective views of the right pivot arm illustrating its "U" shape.

FIG. 10 also illustrates a vertical offset between the drawer pivots 43 and 44 in drawer arm (bottom bar) 31 and stabilizer pivots 45 and 46 in stabilizer arm (top bar) 32. The vertical offset allows a full rotation of 180°. The design of the two pivot arms is such that together they form the end stop for the rotation at 0° and 180°, as seen in FIG. 9*a* and FIG. 9*e*, respectively. The pivot arms (right rear pivot arm 22 and right front pivot arm 23) must be rigid enough to withstand the forces exerted at the pivot points, by the weight of the drawer and its contents, and by the forces exerted by the springs. The "U" shape of the pivot arms (right rear pivot arm 22 and right front pivot arm 23), as can be seen in FIG. 17*a* (showing the right rear pivot arm 22, which can be made identical to right front pivot arm 23), makes this possible.

Figure 11A:
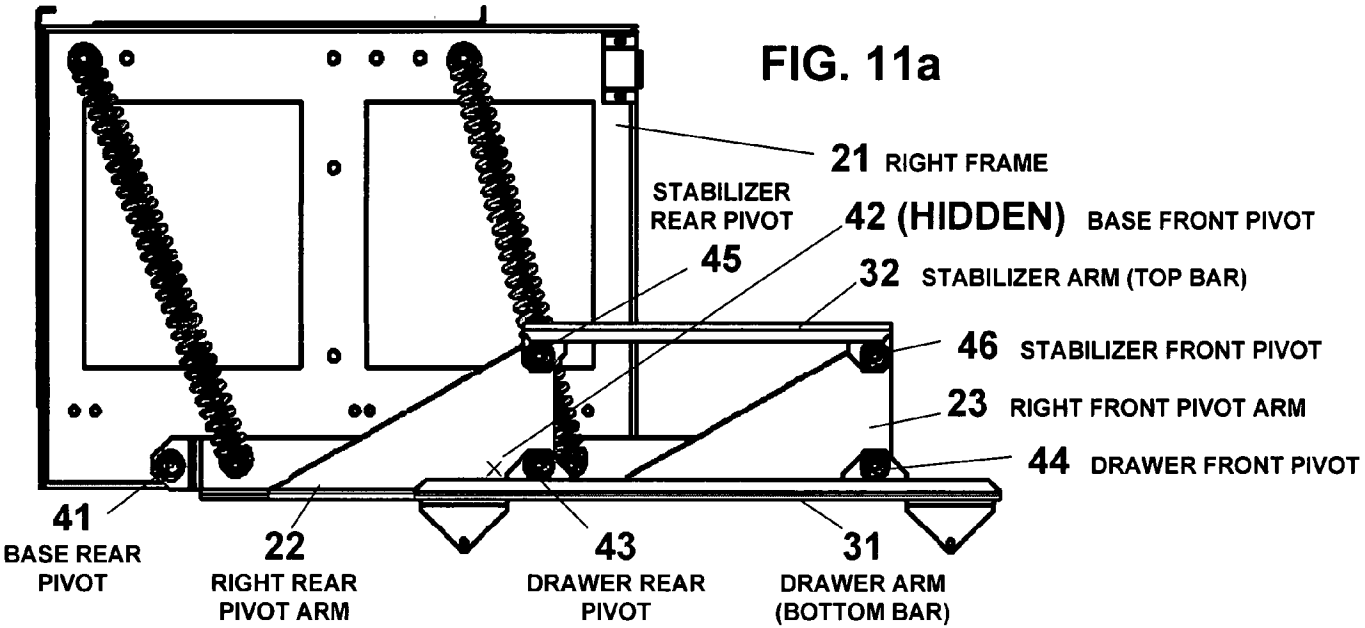
FIG. 11*a* is a side view of the right pivot assembly, showing the inner parallelogram at its undefined position at 0°, and the outer parallelogram at 90°.
Figure 11B:
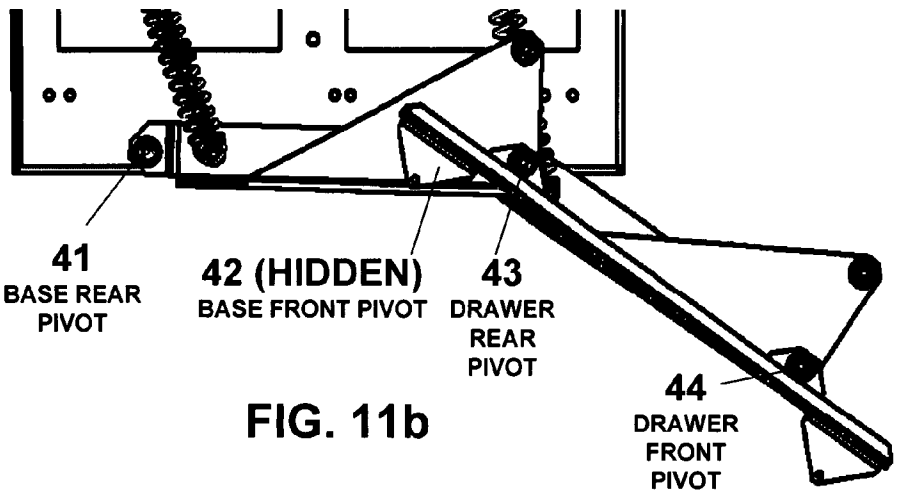
FIG. 11*b* is a side view of the right pivot assembly, showing the possible result from the instability of the inner parallelogram if the outer parallelogram is omitted.

FIG. 11*a* illustrates the inner parallelogram (78, as shown in FIG. 10, with sides 21, 22, 23, and 31; and pivots 41, 42, 43, and 44), with all of its pivot points in line. The stabilizing outer parallelogram (79, as shown in FIG. 10 with sides 31, 22, 32, and 23; and pivots 43, 44, 45, and 46), is shown at a rotation point where the arms of the outer parallelogram are at 90°, forcing the inner parallelogram (78, as shown in FIG. 10) to continue rotation in the expected direction. The inner parallelogram (78, as shown in FIG. 10) would enter into an unstable state if the outer parallelogram (79, as shown in FIG. 10) did not stabilize the inner parallelogram (78, as shown in FIG. 10). FIG. 11*b* shows a possible result if the stabilizer arm (top bar) 32 is omitted. If a drawer assembly (50, not shown here, but able to be attached as shown in FIG. 1) was attached to drawer arm (bottom bar) 31, the drawer assembly (50, as shown in FIG. 1) could lose its horizontal orientation and warp or twist, causing damage to the pivots and the drawer's contents.

Figure 12:
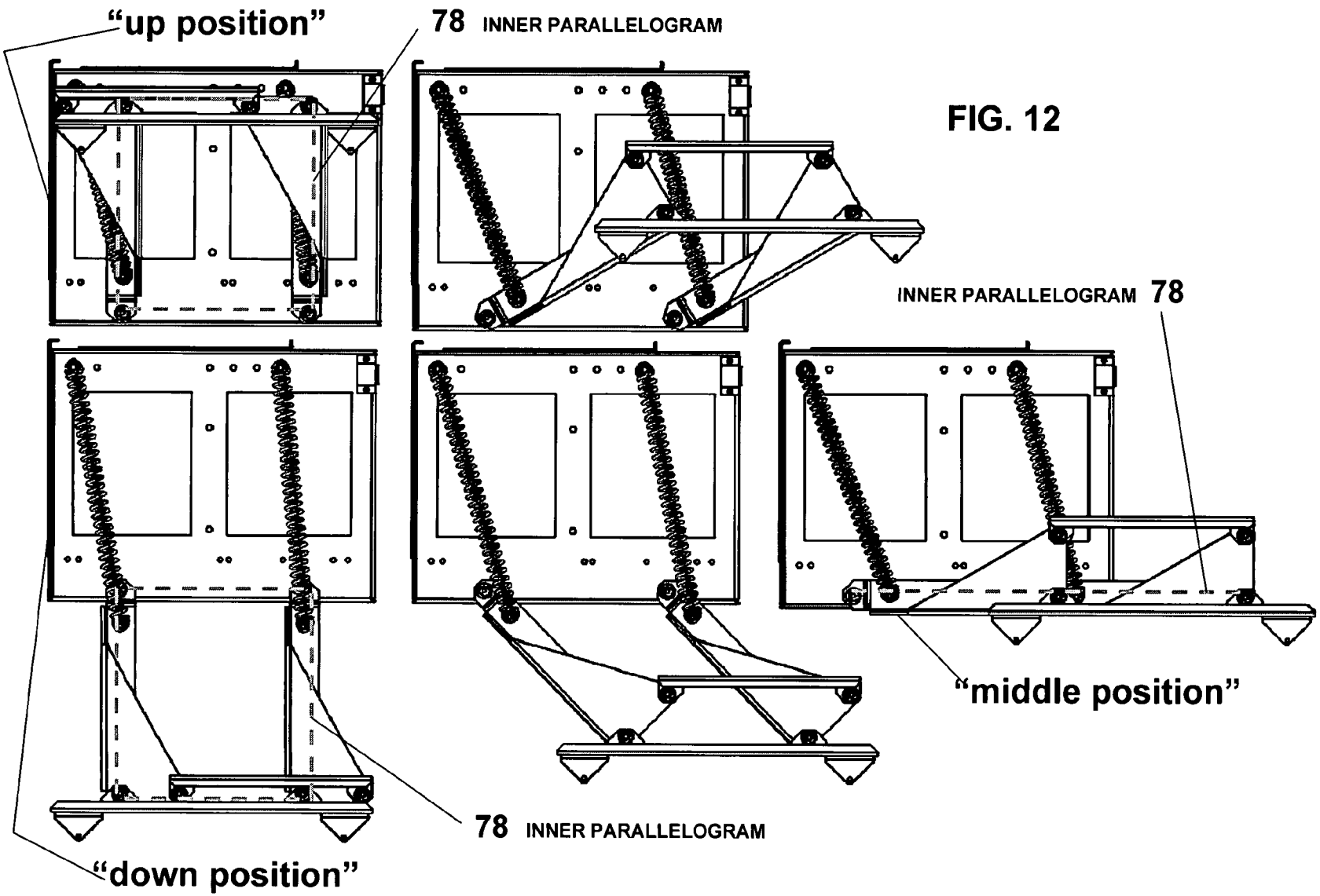
FIG. 12 shows the inner parallelogram at its strongest points ("up position" and "down position") and weakest point ("middle position") in the sequence of movement from the up position to the down position.

FIG. 12 shows the inner parallelogram 78 at its strongest and weakest points in the sequence of movement from the up position to the down position. The inner parallelogram 78 is at its strongest in the up position and in the down position, when the inner parallelogram 78 is rectangular. The inner parallelogram 78 is at its weakest in the middle position when the vertices of the inner parallelogram 78 lie along a straight line, making the inner parallelogram 78 undefined.

Figure 13:
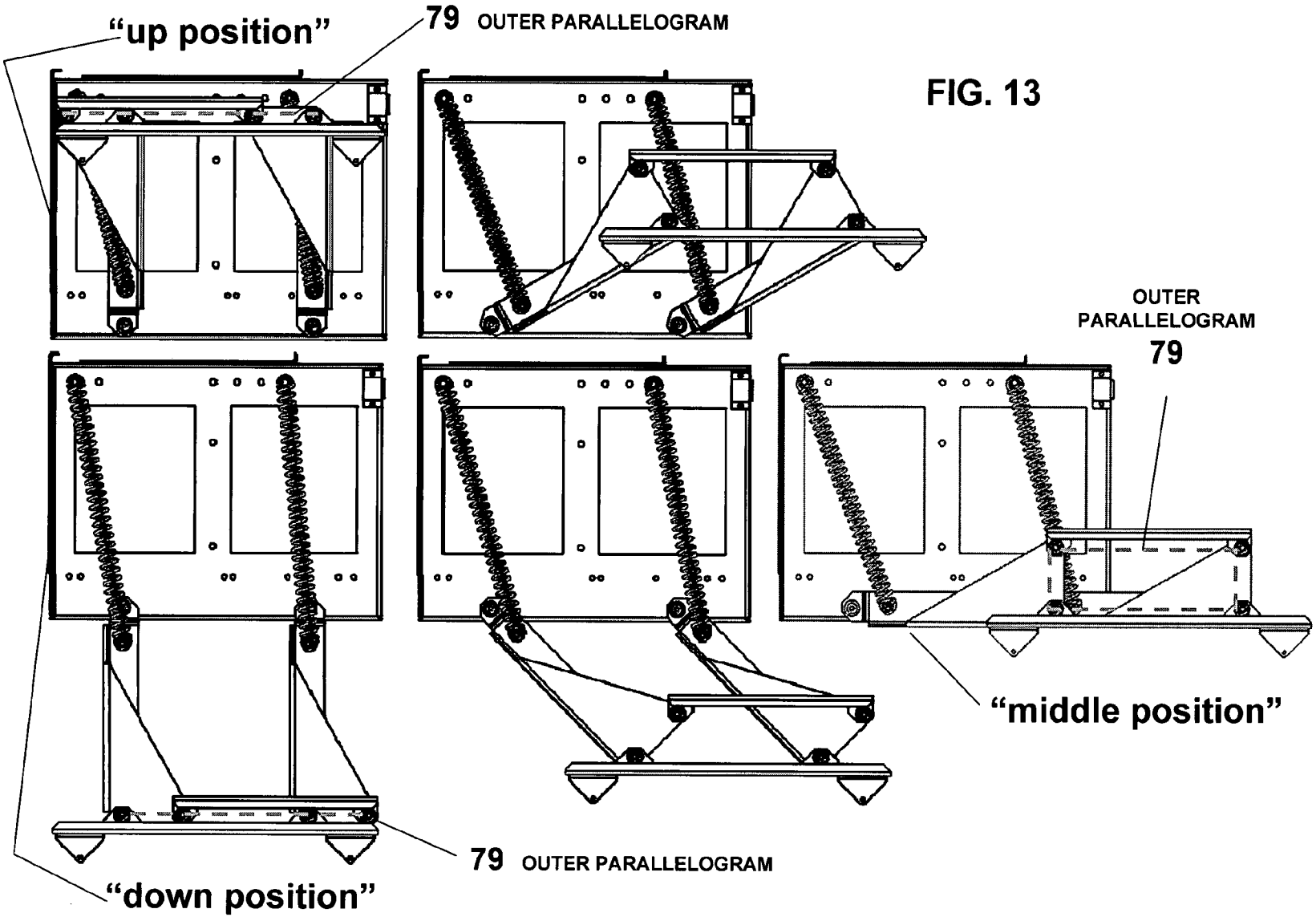
FIG. 13 shows the outer parallelogram at its strongest point ("middle position") and weakest points ("up position" and "down position") in the sequence of movement from the up position to the down position.
Figure 14A:
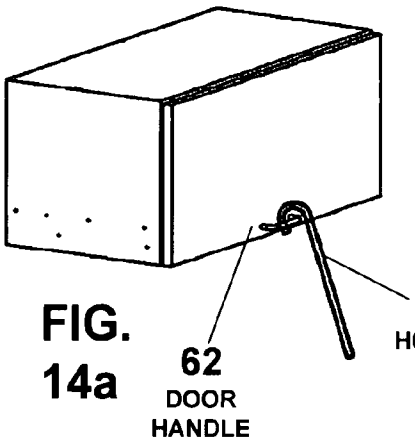
FIG. 14*a* through FIG. 14*d* illustrate the sequence of movement of the parts as they are pulled by a hooking tool from the up position to the down position.
Figure 14B:
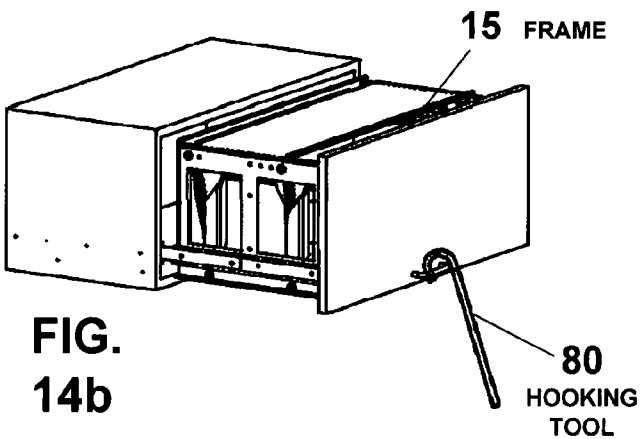
Figure 14C:
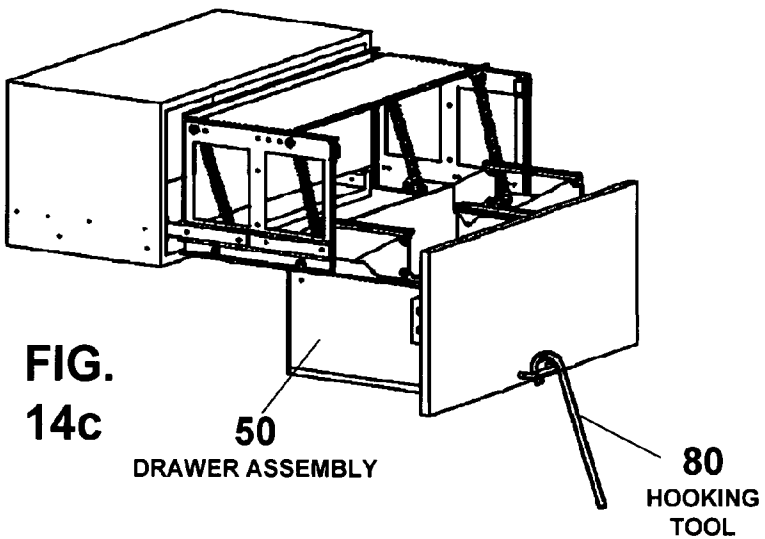
Figure 14D:
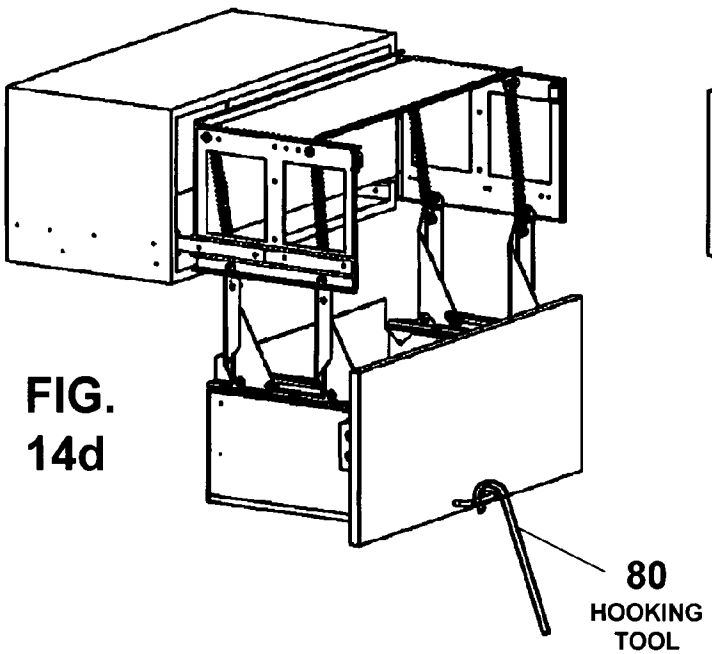

FIG. 13 shows the outer parallelogram 79 at its strongest and weakest points in the sequence of movement from the up position to the down position. The outer parallelogram 79 is at its strongest in the middle position, when the outer parallelogram 79 is rectangular. The outer parallelogram 79 is at its weakest in the up position and in the down position when the vertices of the outer parallelogram 79 lie along a straight line, making the outer parallelogram 79 undefined.

FIG. 14*a* through FIG. 14*d* illustrate the sequence of movement of the parts as they are pulled by a hooking tool 80 from the up position to the down position. By grasping a door handle 62 on the drawer assembly 50 a rigid frame 15 is pulled out horizontally until the frame 15 and the slides (right slide 11 and left slide 12, as shown in FIG. 1) stop at their full extension. In this embodiment a hooking tool 80, if needed, is used to pull on the door handle 62 or otherwise hook to the drawer and pull it out of the cabinet (10, as shown in FIG. 1 and FIG. 3). The hooking tool 80 can be anything long that is adapted to hook onto the drawer, and preferably it is a stick or a rod with a hook attached to the end. The momentum of the drawer assembly 50 moving outward breaks the magnetic latches when the slides (right slide 11 and left slide 12, as shown in FIG. 1) are at a full extension, and the pivot assembly starts a pivoting motion outward and downward. Continuing the pivoting motion takes the drawer all the way downward until the over-center springs snap the drawer fully open.

FIG. 15 shows the drawer assembly utilizing a height stick 82. The height stick 82 may be mounted on the drawer assembly 50 to indicate the maximum height of items which may be placed in the drawer in order for the drawer to fit in the cabinet (10, as shown in FIG. 1).

Figure 16A:
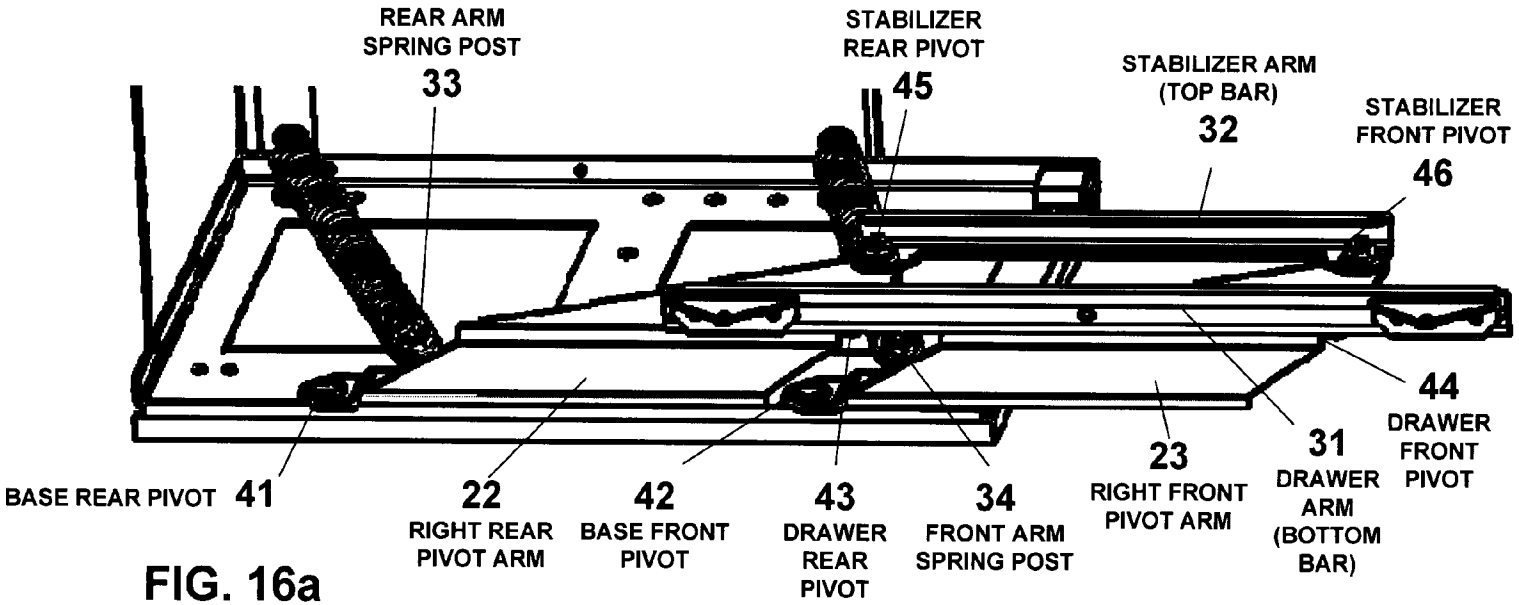
FIG. 16*a* and FIG. 16*b* are perspective views of the right pivot arms as they bypass each other at 0°.
Figure 16B:
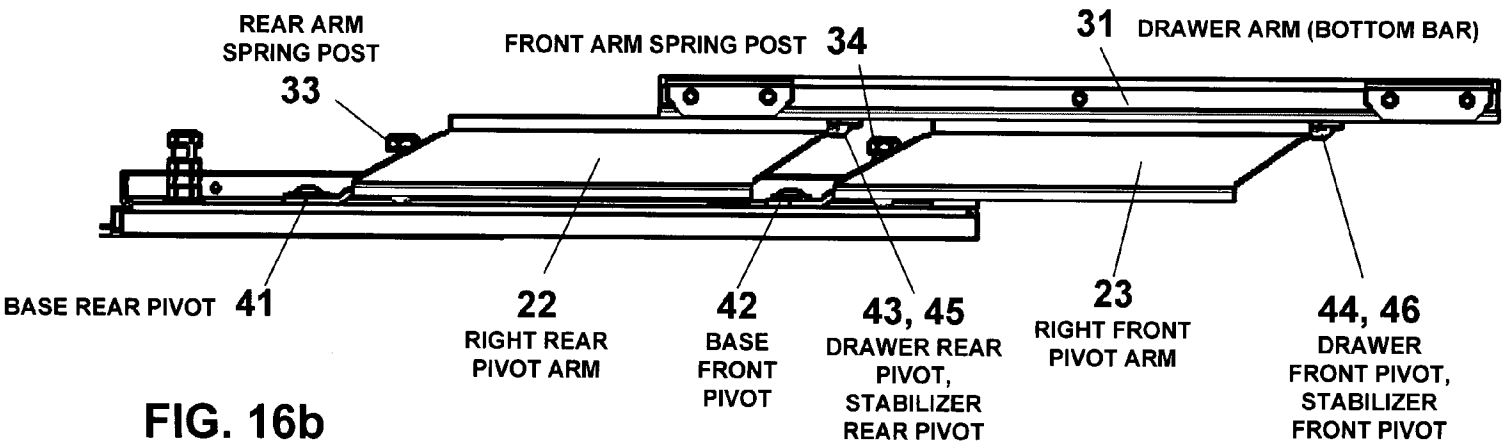

FIG. 16*a* and FIG. 16*b* are perspective views of the right pivot arms (right rear pivot arm 22 and right front pivot arm 23) as they bypass each other at 0° to each other. This orientation creates a problem when the pivot point separation (between base rear pivot 41 and stabilizer rear pivot 45 for right rear pivot arm 22; between base front pivot 42 and stabilizer front pivot 46 for right front pivot arm 23) on the rotating arms is equal to or longer than the pivot point separation (between base rear pivot 41 and base front pivot 42) of the base pivots, as is the case in this implementation. This problem is overcome by first offsetting the physical drawer pivot axes (stabilizer rear pivot 45, stabilizer front pivot 46, drawer rear pivot 43, and drawer front pivot 44) from the base pivot axes (base rear pivot 41 and base front pivot 42), in the direction of the axes, to bypass rear arm spring post 33 and front arm spring post 34. Then the pivot arms must be beveled or notched appropriately to bypass the actual physical pivots, as shown in FIG. 16*a* and FIG. 16*b*. The stabilizer arm 32 and the drawer arm 31 are then free to rotate along a common constant plane, a plane that is distinct from the plane along which the spring posts (rear arm spring post 33 and front arm spring post 34) are located. The base pivots (base rear pivot 41 and base front pivot 42) are adapted to be pivotally connected to a rigid element such that each pivot arm (right rear pivot arm 22 and right front pivot arm 23) is free to rotate about that pivot arm's base pivot (base rear pivot 41 and base front pivot 42, respectively) without impedance by the rigid element. The drawer front pivot 44 and the drawer rear pivot 43 rotate along a common constant plane so that the drawer assembly (50, as shown in FIG. 1) uniformly folds out of the frame (15, as shown in FIG. 3). Similarly, the stabilizer front pivot 46 and the stabilizer rear pivot 45 rotate along a common constant plane so that the drawer assembly (50, as shown in FIG. 1) uniformly folds out of the frame (15, as shown in FIG. 3).

Figure 17B:
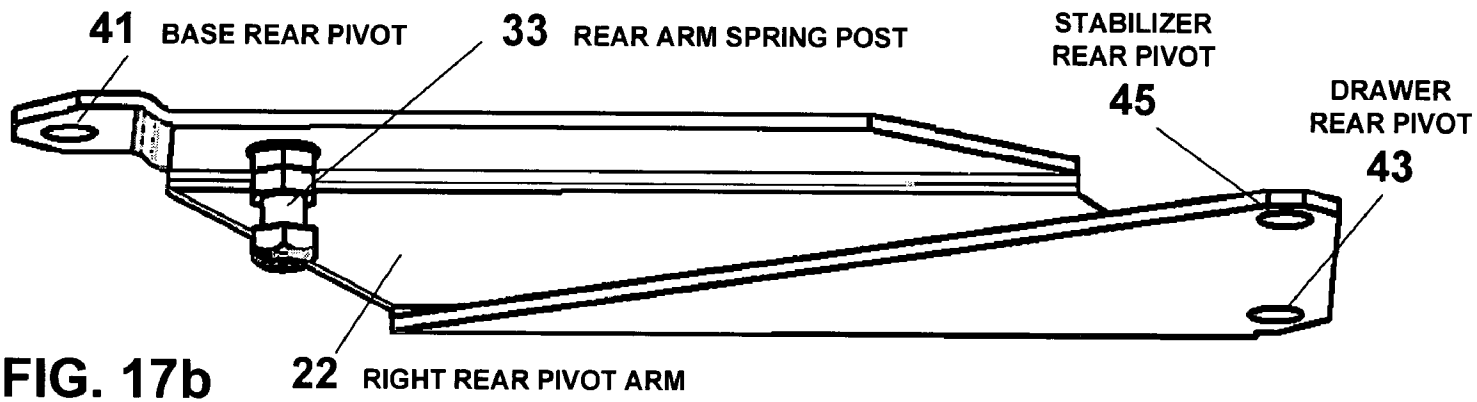

FIG. 17*a* and FIG. 17*b* illustrate the "U" shape of the right rear pivot arm 22, which is identical to the right front pivot arm (23, as shown in FIG. 4) in one embodiment, and is also a mirror image of the left rear pivot arm (27, as shown in FIG. 5) and left front pivot arm (28, as shown in FIG. 5). The "U" shape design is used to offset the pivot points (stabilizer rear pivot 45, drawer rear pivot 43, and base rear pivot 41) so that they may bypass each other, as described earlier, and also to make room for the spring posts (rear arm spring post 33 shown) and springs while these arms rotate 180°. This overall design of the pivot arms is an important and unique part of this invention, solving obstacles presented by the complex and conflicting requirements encountered.

| | | Drawing Number | | | | | | | | | | | | | | | |
|---|---|---|---|---|---|---|---|---|---|---|---|---|---|---|---|---|---|
| Item Number | Item Name | 1 | 2 | 3 | 4 | 5 | 6 | 7 | 8 | 9 | 10 | 11 | 12 | 13 | 14 | 15 | 16 | 17 |
| 10 | Cabinet | x | | x | | | | | | | | | | | | | | |
| 11 | Right Slide | x | | | x | | | | | | | | | | | | | |
| 12 | Left Slide | x | x | | | x | | | | | | | | | | | | |
| 13 | | | | | | | | | | | | | | | | | | |
| 14 | | | | | | | | | | | | | | | | | | |
| 15 | Frame | | x | x | | | | | | | | | | | x | | | |
| 16 | Frame Back | | | x | | | | | | | | | | | | | | |
| 17 | Frame Top | | | x | | | | | | | | | | | | | | |
| 18 | | | | | | | | | | | | | | | | | | |
| 19 | | | | | | | | | | | | | | | | | | |
| 20 | Right Pivot Assembly | x | | | x | | | | | | | | | | | | | |
| 21 | Right Frame | | | x | x | | | | | | x | x | | | | | | |
| 22 | Right Rear Pivot Arm | | | | x | | | | | | x | x | | | | | x | X |
| 23 | Right Front Pivot Arm | | | | x | | | | | | x | x | | | | | x | |
| 24 | | | | | | | | | | | | | | | | | | |
| 25 | Left Pivot Assembly | x | | | | x | | | | | | | | | | | | |
| 26 | Left Frame | | | x | | x | | | x | | | | | | | | | |
| 27 | Left Rear Pivot Arm | | | | | x | | | | | | | | | | | | |
| 28 | Left Front Pivot Arm | | | | | x | | | | | | | | | | | | |
| 29 | | | | | | | | | | | | | | | | | | |
| 30 | | | | | | | | | | | | | | | | | | |

-continued

| | | Drawing Number | | | | | | | | | | | | | | | | |
|---|---|---|---|---|---|---|---|---|---|---|---|---|---|---|---|---|---|---|
| Item Number | Item Name | 1 | 2 | 3 | 4 | 5 | 6 | 7 | 8 | 9 | 10 | 11 | 12 | 13 | 14 | 15 | 16 | 17 |
| 31 | Drawer Arm (Bottom Bar) | | | | x | x | | | | | x | x | | | | | x | |
| 32 | Stabilizer Arm (Top Bar) | | | | x | x | | | | | x | x | | | | | x | |
| 33 | Rear Arm Spring Post | | | | x | x | | | | | | | | | | | x | X |
| 34 | Front Arm Spring Post | | | | x | x | | | | | | | | | | | x | |
| 35 | Rear Frame Spring Post | | | | x | x | | | | | | | | | | | | |
| 36 | Front Frame Spring Post | | | | x | x | | | | | | | | | | | | |
| 37 | Rear Drawer Hanger | | | | x | x | | | | | | | | | | | | |
| 38 | Front Drawer Hanger | | | | x | x | | | | | | | | | | | | |
| 39 | Magnet | | | | x | x | | | x | | | | | | | | | |
| 40 | | | | | | | | | | | | | | | | | | |
| 41 | Base Rear Pivot | | | | x | x | | | | | x | x | | | | | x | X |
| 42 | Base Front Pivot | | | | x | x | | | | | x | x | | | | | x | |
| 43 | Drawer Rear Pivot | | | | x | x | | | | | x | x | | | | | x | x |
| 44 | Drawer Front Pivot | | | | x | x | | | | | x | x | | | | | x | |
| 45 | Stabilizer Rear Pivot | | | | x | x | | | | | x | x | | | | | x | x |
| 46 | Stabilizer Front Pivot | | | | x | x | | | | | x | x | | | | | x | |
| 47 | Rear Spring | | | | x | x | | | | | | | | | | | | |
| 48 | Front Spring | | | | x | x | | | | | | | | | | | | |
| 49 | | | | | | | | | | | | | | | | | | |
| 50 | Drawer Assembly | x | x | | | | x | | x | | | | | | x | x | | |
| 51 | Drawer Right Side | | | | | | x | | | | | | | | | | | |
| 52 | Drawer Left Side | | | | | | x | | | | | | | | | | | |
| 53 | Drawer Back | | | | | | x | | | | | | | | | | | |
| 54 | Drawer Bottom | | | | | | x | | | | | | | | | | | |
| 55 | Drawer Window | | | | | | x | | | | | | | | | | | |
| 56 | Catch Mounting Block | | | | | | x | | x | | | | | | | | | |
| 57 | Elbow Catch Strike | | | | | | x | | x | | | | | | | | | |
| 58 | | | | | | | | | | | | | | | | | | |
| 59 | | | | | | | | | | | | | | | | | | |
| 60 | Flip Door Assembly | x | | | | | x | | | | | | | | | | | |
| 61 | Flip Door | | | | | | x | | x | | | | | | | | | |
| 62 | Door Handle | | x | | | | | | x | | | | | | x | | | |
| 63 | Magnet Plate | | | | | | x | x | x | | | | | | | | | |
| 64 | Elbow Catch | | x | | | | x | | x | | | | | | | | | |
| 65 | Piano Hinge | | | | | | x | | x | | | | | | | | | |
| 66 | | | | | | | | | | | | | | | | | | |
| 67 | | | | | | | | | | | | | | | | | | |
| 68 | | | | | | | | | | | | | | | | | | |
| 69 | | | | | | | | | | | | | | | | | | |
| 70 | Side Drawer Assembly | | | | | | | x | | | | | | | | | | |
| 71 | Side Drawer Right Side | | | | | | | x | | | | | | | | | | |
| 72 | Side Drawer Left Side | | | | | | | x | | | | | | | | | | |
| 73 | Side Drawer Back | | | | | | | x | | | | | | | | | | |
| 74 | Side Drawer Bottom | | | | | | | x | | | | | | | | | | |
| 75 | Side Drawer Front | | | | | | | x | | | | | | | | | | |

-continued

| Item Number | Item Name | Drawing Number 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|---|
| 76 | Side Drawer Door Panel | | | | | | | x | | | | | | | | | | |
| 78 | Inner Parallelogram | | | | | | | | | | x | | x | | | | | |
| 79 | Outer Parallelogram | | | | | | | | | | x | | | x | | | | |
| 80 | Hooking Tool | | | | | | | | | | | | | | x | | | |
| 81 | Slide Catch | | x | | | | | | | | | | | | | | | |
| 82 | Height Stick | | | | | | | | | | | | | | | x | | |

I claim:

1. A pivot assembly comprising:

a. a front pivot arm pivotally connected to a top bar and a bottom bar, and a rear pivot arm connected to the top bar and the bottom bar;

b. said pivotally connections between said pivot arms and said bars forming an outer parallelogram;

c. said pivot arms pivotally connected to a rigid element, said pivot arms rotating around said connection with said rigid element from an up position, through a middle position, and to a down position, the bars spaced apart in the middle position and touching in the up position and the down position;

d. said connections between said pivot arms and said rigid element and said connections between said pivot arms and said bottom bar forming an inner parallelogram;

e. said inner parallelogram forming a substantially rectangular shape in said up position and said down position, said inner parallelogram becoming undefined in said middle position;

f. said outer parallelogram forming a substantially rectangular shape in said middle position, said outer parallelogram preventing warping when said pivot arms pass through said middle position, said outer parallelogram forming a non-rectangular shape in said up position and said down position.

2. A pivot assembly comprising:

a. a rear pivot arm with a base pivot, a drawer pivot, and a stabilizer pivot, the drawer pivot of said rear pivot arm pivotally connecting the rear pivot arm to a rear end of a bottom bar, and the stabilizer pivot of said rear pivot arm pivotally connecting the rear pivot arm to a rear end of a top bar;

b. a front pivot arm with a base pivot, a drawer pivot, and a stabilizer pivot that correspond to the base pivot, the drawer pivot, and the stabilizer pivot of the rear pivot arm, the drawer pivot of said front pivot arm pivotally connecting the front pivot arm to a front end of the bottom bar, and the stabilizer pivot of said front pivot arm pivotally connecting the front pivot arm to a front end of a top bar;

c. said bars disposed substantially parallel to each other such that an outer parallelogram is formed with a bottom side from the drawer pivot of the front pivot arm to the drawer pivot of the rear pivot arm, a rear side from the drawer pivot of the rear pivot arm to the stabilizer pivot of the rear pivot arm, a top side from the stabilizer pivot of the rear pivot arm to the stabilizer pivot of the front pivot arm, and a front side from the stabilizer pivot of the front pivot arm to the drawer pivot of the front pivot arm;

d. the base pivot of both pivot arms adapted to be pivotally connected to a rigid element such that each pivot arm is free to rotate about that pivot arm's base pivot without impedance by the rigid element, the drawer pivot of the front pivot arm and the drawer pivot of the rear pivot arm rotating along a common constant plane, and the stabilizer pivot of the front pivot arm and the stabilizer pivot of the rear pivot arm rotating along a common constant plane;

e. said base pivots disposed such that an inner parallelogram is formed with a first side from the drawer pivot of the front pivot arm to the drawer pivot of the rear pivot arm, a second side from the drawer pivot of the rear pivot arm to the base pivot of the rear pivot arm, a third side from the base pivot of the rear pivot arm to the base pivot of the front pivot arm, and a fourth side from the base pivot of the front pivot arm to the drawer pivot of the front pivot arm;

f. each pivot arm having a shape and size that allows the rear pivot arm to rotate about the rear pivot arm's base pivot without impedance by the front pivot arm; and g. the top bar adapted to rest on the bottom bar when the pivot arms are in an up position, the top bar separated from the bottom bar as the pivot arms are rotated from the up position to a down position, and the top bar adapted to rest on the bottom bar when the pivot arms are in a down position;

h. said inner parallelogram forming a substantially rectangular shape in both said up position and said down position, said inner parallelogram becoming undefined when the pivot arms are in a middle position;

i. said outer parallelogram forming a substantially rectangular shape in said middle position, said outer parallelogram preventing warping when said pivot arms pass through said middle position, said outer parallelogram forming a non-rectangular shape in said up position and said down position.

3. The pivot assembly of claim 2, wherein the pivot arms have a U-shape, the U-shape of the pivot arms providing structural stability to the pivot arms and providing space to attach a spring to a pivot arm.

4. The pivot assembly of claim 2, wherein the pivot arms are beveled or notched, the bevel or notch offsetting the rear pivot arm from the front pivot arm so that they may bypass each other.

5. The pivot assembly of claim 2, wherein the pivot arms can be rotated from the up position forward 180 degrees to the down position.

6. The pivot assembly of claim 2, wherein the pivot assembly comprises a right pivot assembly and a left pivot assembly.

7. The pivot assembly of claim 6, further comprising a frame, the frame having a right side, a left side, a back side, and a top side, the right side of the frame serving as the rigid element for the right pivot assembly and the left side of the frame serving as the rigid element for the left pivot assembly.

8. The pivot assembly of claim 7, wherein the sides of the frame have longitudinal bends to provide structural support.

9. The pivot assembly of claim 7, wherein the frame is connected to a pair of drawer slides, the drawer slides adapted to fit into a cabinet.

10. The pivot assembly of claim 9, wherein each drawer slide has a catch to limit how far the slide can extend.

11. The pivot assembly of claim 10, wherein the right pivot assembly is connected to a right side of a drawer and the left pivot assembly is connected to a left side of said drawer, the left pivot assembly and the right pivot assembly rotating approximately together under the influence of said drawer.

12. The pivot assembly of claim 11, wherein the drawer has a front adapted to be handled by a person.

13. The pivot assembly of claim 11, wherein a right spring is connected to the right frame on a first end, said right spring is connected to the right pivot assembly on a second end, a left spring connected to the left frame on a first end, said left spring connected to the left pivot assembly on a second end.

14. The pivot assembly of claim 13, wherein the right spring comprises a pair of right springs and the left spring comprises a pair of left springs.

15. The pivot assembly of claim 12, wherein a latch removably connects the frame to a back side of the drawer front, the latch adapted to withstand a pull force exerted on the drawer as the drawer slides out of the cabinet, and the latch adapted to disengage due to the pull force when the slide catches stop the frame from sliding out, after the latch disengages the drawer pivoting outward and downward from the up position to the down position under the influence of the pivot assemblies.

16. The pivot assembly of claim 15, wherein the latch comprises a magnetic latch.

17. The pivot assembly of claim 15, wherein the latch comprises a right and a left magnetic latch, the right magnetic latch removably connecting the right side of the frame to a right back side of the drawer front, the left magnetic latch removably connecting the left side of the frame to a left back side of the drawer front.

18. The pivot assembly of claim 12, wherein the drawer is adapted to be handled by a person via a handle.

19. The pivot assembly of claim 11, wherein the front of the drawer comprises a door that flips down, said door adapted to be locked in a closed position.

20. The pivot assembly of claim 19, wherein the door flips down from the drawer on hinges.

21. The pivot assembly of claim 20, wherein the hinges are piano hinges.

22. The pivot assembly of claim 19, wherein the door locks with an elbow catch, the elbow catch connected to an inner side of the door, a catch mounting block with an elbow catch strike connected to a side of the drawer.

23. The pivot assembly of claim 22, wherein the elbow catch strike is mounted at an angle to the elbow catch.

24. The pivot assembly of claim 11, wherein a bottom of the drawer has a cutout, and a window is set in the cutout.

25. The pivot assembly of claim 11, wherein a bottom of the drawer is transparent.

26. The pivot assembly of claim 11, wherein a back of the drawer has a height that represents the maximum height that will fit in the cabinet, the height of the back of the drawer indicating the maximum height of items which can be placed in the drawer.

27. The pivot assembly of claim 11, wherein a side of the drawer has a cutout.

28. The pivot assembly of claim 18, wherein the handle is adapted to be pulled by an elongated hook tool.

29. The pivot assembly of claim 11, wherein a stick is mounted vertically in the drawer, the stick having a height that represents the maximum height that will fit in the cabinet, the height of the stick indicating the maximum height of items which can be placed in the drawer.

* * * * *